US010290249B2

(12) United States Patent
Morita

(10) Patent No.: US 10,290,249 B2
(45) Date of Patent: May 14, 2019

(54) DRIVER, ELECTRO-OPTICAL APPARATUS, AND ELECTRONIC DEVICE

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 509 days.

(21) Appl. No.: 14/996,999

(22) Filed: Jan. 15, 2016

(65) Prior Publication Data

US 2016/0217759 A1 Jul. 28, 2016

(30) Foreign Application Priority Data

Jan. 27, 2015 (JP) ..... 2015-012989

(51) Int. Cl.
*G09G 3/20* (2006.01)

(52) U.S. Cl.
CPC ..... *G09G 3/20* (2013.01); *G09G 2310/0275* (2013.01)

(58) Field of Classification Search
CPC .... G09G 3/3688; G09G 3/006; G09G 3/3655; G09G 2310/0275; G09G 2310/0297
See application file for complete search history.

(56) References Cited

U.S. PATENT DOCUMENTS

| | | | | |
|---|---|---|---|---|
| 6,040,814 | A * | 3/2000 | Murakami | G09G 3/3648 345/209 |
| 6,420,988 | B1 * | 7/2002 | Azami | G09G 3/3275 341/144 |
| 6,486,812 | B1 | 11/2002 | Tanaka | |
| 6,606,045 | B2 | 8/2003 | Azami et al. | |
| 8,059,021 | B2 | 11/2011 | Kuramochi | |
| 8,400,439 | B2 | 3/2013 | Morita | |
| 8,502,765 | B2 | 8/2013 | Yokoyama et al. | |
| 2002/0163457 | A1 | 11/2002 | Azami et al. | |
| 2005/0190139 | A1 | 9/2005 | Fujiyoshi | |
| 2008/0136984 | A1 | 6/2008 | Yokoyama et al. | |
| 2010/0194718 | A1 * | 8/2010 | Morita | G09G 3/3688 345/204 |
| 2011/0148680 | A1 | 6/2011 | Kuramochi | |
| 2013/0300963 | A1 | 11/2013 | Yokoyama et al. | |
| 2015/0009188 | A1 * | 1/2015 | Choi | G09G 3/20 345/204 |

(Continued)

FOREIGN PATENT DOCUMENTS

| | | | |
|---|---|---|---|
| JP | 2000-341125 | A | 12/2000 |
| JP | 2001-156641 | A | 6/2001 |
| JP | 2005-242215 | A | 9/2005 |

(Continued)

*Primary Examiner* — Koosha Sharifi-Tafreshi
(74) *Attorney, Agent, or Firm* — Oliff PLC

(57) ABSTRACT

A driver and an electronic device include a driving circuit having a plurality of data line driving circuits that drive a plurality of data lines in an electro-optical panel, a measurement circuit that measures a voltage in the data lines, and a computation circuit that computes a correction coefficient for correcting display data. Based on a measurement result, the computation circuit computes the correction coefficient that changes in accordance with a coupling capacitance between one data line and a data line adjacent thereto.

20 Claims, 12 Drawing Sheets

(56) References Cited

U.S. PATENT DOCUMENTS

2015/0049073 A1 2/2015 Morita

FOREIGN PATENT DOCUMENTS

| | | | |
|---|---|---|---|
| JP | 2006-243176 | A | 9/2006 |
| JP | 2007-003967 | A | 1/2007 |
| JP | 2008-083727 | A | 4/2008 |
| JP | 2008-145993 | A | 6/2008 |
| JP | 2010-102080 | A | 5/2010 |
| JP | 2010-181506 | A | 8/2010 |
| JP | 2011-130440 | A | 6/2011 |
| JP | 2015-036757 | A | 2/2015 |
| JP | 2015-038543 | A | 2/2015 |

* cited by examiner $$\Delta VQ1 = \frac{C12}{C12+C1G}\,\Delta VQ2 \quad \text{FA}$$

$$\Delta VQ2 = \frac{C12}{C12+C23G+C2G}\,\Delta VQ1 + \frac{C23}{C12+C23G+C2G}\,\Delta VQ3 \quad \text{FB}$$

| | DL1 (VQ1) | | COEFFI-CIENT | | DL2 (VQ2) | | COEFFI-CIENT | | DL3 (VQ3) | | COEFFI-CIENT | | DL4 (VQ4) |
|---|---|---|---|---|---|---|---|---|---|---|---|---|---|
| TARGET VOLTAGE [mV] | 100 | | | | 100 | | | | 100 | | | | 100 |
| SET VOLTAGE [mV] | 100 | | | | 100 | | | | 100 | | | | 100 |
| | | → | 0.2 | → | | → | 0.24 | → | | → | 0.1 | → | |
| | | ← | 0.25 | ← | | ← | 0.3 | ← | | ← | 0.3 | ← | |
| RESULTING VOLTAGE [mV] | 125 | | | | 150 | | | | 154 | | | | 110 |

FIG. 5A

| | DL1 (VQ1) | | COEFFI-CIENT | | DL2 (VQ2) | | COEFFI-CIENT | | DL3 (VQ3) | | COEFFI-CIENT | | DL4 (VQ4) |
|---|---|---|---|---|---|---|---|---|---|---|---|---|---|
| TARGET VOLTAGE [mV] | 100 | | | | 100 | | | | 100 | | | | 100 |
| SET VOLTAGE [mV] | 75 | | | | 50 | | | | 46 | | | | 90 |
| | | → | 0.2 | → | | → | 0.24 | → | | → | 0.1 | → | |
| | | ← | 0.25 | ← | | ← | 0.3 | ← | | ← | 0.3 | ← | |
| RESULTING VOLTAGE [mV] | 100 | | | | 100 | | | | 100 | | | | 100 |

FIG. 5B

DRIVER, ELECTRO-OPTICAL APPARATUS, AND ELECTRONIC DEVICE

BACKGROUND

1. Technical Field

The present invention relates to drivers, electro-optical apparatuses, electronic devices, and the like.

2. Related Art

Display devices (liquid-crystal display devices, for example) are used in a variety of electronic devices, including projectors, information processing apparatuses, mobile information terminals, and the like. Increases in the resolutions of such display devices continue to progress, and as a result, the time a driver drives a single pixel is becoming shorter. For example, phase expansion driving is used as a method for driving an electro-optical panel (a liquid-crystal display panel, for example). According to this driving method, for example, eight source lines are driven at one time, and the process is repeated 160 times to drive 1,280 source lines. In the case where a WXGA (1,280×768 pixels) panel is to be driven, the stated 160 instances of driving (that is, the driving of a single horizontal scanning line) is thus repeated 768 times. Assuming a refresh rate of 60 Hz, a simple calculation shows that the driving time for a single pixel is approximately 135 nanoseconds. In actuality, there are periods where pixels are not driven (blanking intervals and the like, for example), and thus the driving time for a single pixel becomes even shorter, at approximately 70 nanoseconds.

JP-A-2000-341125, JP-A-2001-156641, JP-A-2008-145993, JP-A-2008-83727, JP-A-2006-243176, and JP-A-2005-242215 are examples of related art.

With the shortening of pixel driving times as mentioned above, it is becoming difficult for amplifier circuits to finish writing data voltages within the required time. A method that drives an electro-optical panel by controlling the amounts of charges supplied to data lines (a method that employs capacitor charge redistribution, for example) can be considered as a driving method for addressing this problem. Unlike driving using an amplifier circuit, this method supplies a predetermined charge amount corresponding to a data voltage, and thus when there is a factor that causes the distribution of charges to change, error occurs with respect to the data voltage.

Specifically, a plurality of data lines are provided in the electro-optical panel, and a coupling capacitance (parasitic capacitance) is present among those data lines. Focusing on a given data line, the data line adjacent thereto is connected through coupling capacitance, and thus the charge redistribution is carried out including that coupling capacitance. If the potential of the adjacent data line is constant, the same charge redistribution will occur each time. However, the potential of the data line changes due to pixel driving, and there is thus a problem that that potential change causes a change in the charge redistribution in the data line being focused on, which in turn produces error from the desired data voltage.

JP-A-2000-341125 and JP-A-2001-156641 disclose techniques in which D/A conversion is carried out through capacitor charge redistribution as techniques that employ charge redistribution. JP-A-2008-145993, JP-A-2008-83727, JP-A-2006-243176, and JP-A-2005-242215, meanwhile, disclose techniques for driving an electro-optical panel using voltage followers, capacitors, or the like.

SUMMARY

An advantage of some aspects of the invention is to provide a driver, an electro-optical apparatus, an electronic device, and the like capable of suppressing error in a data voltage caused by coupling capacitance between data lines.

One aspect of this invention relates to a driver including a driving circuit having first to kth data line driving circuits that drive first to kth data lines (where k is a natural number of 2 or more) of an electro-optical panel, a measurement circuit that measures a voltage in the first to kth data lines, and a computation circuit that computes a correction coefficient for correcting display data; on the basis of a measurement result from the measurement circuit, the computation circuit computes the correction coefficient that changes in accordance with coupling capacitance between an ith data line of the first to kth data lines (where i is a natural number less than or equal to k) and a data line adjacent to the ith data line.

According to this aspect of the invention, the voltage in the first to kth data lines is measured, and the correction coefficient, which changes in accordance with the coupling capacitance between the ith data line and a data line adjacent to the ith data line, is computed on the basis of a result of that measurement. Accordingly, display data can be corrected using the correction coefficient obtained through the computation, and by the driving circuit driving the data lines on the basis of the corrected display data, data voltage error caused by coupling capacitance between data lines can be suppressed.

According to another aspect of the invention, the correction coefficient may be a correction coefficient based on a ratio of the coupling capacitance to an overall capacitance of the ith data line.

Voltage error in the ith data line is proportional to the ratio of the coupling capacitance to the overall capacitance of the ith data line. Accordingly, by finding the correction coefficient based on that ratio, voltage error caused by coupling between the ith data line and the data line adjacent thereto can be corrected appropriately.

According to another aspect of the invention, the correction coefficient may include a first correction coefficient based on a first coupling capacitance between the ith data line and an i−1th data line of the first to kth data lines, and a second correction coefficient based on a second coupling capacitance between the ith data line and an i+1th data line of the first to kth data lines.

Voltage error in the ith data line includes a term proportional to the first coupling capacitance between the ith data line and the i−1th data line and a term proportional to the second coupling capacitance between the ith data line and the i+1th data line. Accordingly, voltage error caused by coupling between the ith data line and the data line adjacent thereto can be corrected appropriately by finding the first correction coefficient based on the first coupling capacitance and the second correction coefficient based on the second coupling capacitance.

According to another aspect of the invention, the first correction coefficient may be a correction coefficient based on a ratio of the first coupling capacitance to an overall capacitance of the ith data line, and the second correction coefficient may be a correction coefficient based on a ratio of the second coupling capacitance to the overall capacitance of the ith data line.

Voltage error in the ith data line includes a term proportional to the ratio of the first coupling capacitance to the overall capacitance of the ith data line and a term proportional to the ratio of the second coupling capacitance to the overall capacitance of the ith data line. Accordingly, by finding the first correction coefficient and the second correction coefficient based on that ratio, voltage error caused by coupling between the ith data line and the data line adjacent thereto can be corrected appropriately.

According to another aspect of the invention, the ith data line driving circuit may set the ith data line to a data voltage corresponding to the display data by controlling an amount of a charge supplied to the ith data line.

According to such a driving method, a charge of a set amount corresponding to the display data is outputted, rather than a charge being freely inputted and outputted in accordance with an output voltage, as with an amplifier circuit or the like. Accordingly, charge distribution changes in accordance with a voltage change in the adjacent data line due to the coupling capacitance, producing error in the data voltage. With respect to this point, according to this aspect of the invention, the display data can be corrected using the correction coefficient based on the coupling capacitance, and the data voltage error caused by the coupling capacitance can be corrected.

According to another aspect of the invention, the computation circuit may change the display data supplied to the i+1th data line driving circuit of the first to kth data line driving circuits from first display data to second display data, the measurement circuit may measure an amount of change in the voltage of the ith data line, and the computation circuit may compute the correction coefficient based on the coupling capacitance between the ith data line and the i+1th data line of the first to kth data lines on the basis of the amount of change in the voltage.

Voltage error in the ith data line is proportional to the value of change in the display data corresponding to the data line adjacent to the ith data line. Accordingly, by changing the display data supplied to the i+1th data line driving circuit from the first display data to the second display data and measuring the amount of change in the voltage of the ith data line, voltage error in the ith data line relative to the value of the change in the display data can be found, and the correction coefficient can then be found from that voltage error.

According to another aspect of the invention, when the computation circuit changes the display data supplied to the i+1th data line driving circuit from the first display data to the second display data, the ith data line driving circuit may set the ith data line to a state in which a charge in the ith data line is conserved.

By setting the ith data line to a state in which the charge in the ith data line is conserved when measuring the voltage in the ith data line, the ith data line can be set to the same condition as when carrying out capacitive driving. Accordingly, voltage error caused by coupling can be measured accurately.

According to another aspect of the invention, the driver further includes a correction circuit that carries out a correction process on the display data and supplies the corrected display data to the driving circuit, and the correction circuit supplies, to the ith data line driving circuit of the first to kth data line driving circuits, the display data corrected using the correction coefficient based on the coupling capacitance between the ith data line and the data line adjacent to the ith data line.

According to this aspect of the invention, the display data is corrected using a correction coefficient based on the coupling capacitance between the ith data line and the data line adjacent to the ith data line, the corrected display data is supplied to the ith data line driving circuit, and the ith data line is driven by the ith data line driving circuit on the basis of the corrected display data. Through this, a data voltage can be corrected using the correction coefficient based on the coupling capacitance between the data lines, and thus data voltage error caused by the coupling capacitance between the data lines can be suppressed.

According to another aspect of the invention, the correction circuit may carry out the correction process on the display data corresponding to the ith data line on the basis of a value of change in the display data corresponding to the data line adjacent to the ith data line and on the basis of the correction coefficient.

Voltage error in the ith data line is proportional to the value of change in the display data corresponding to the data line adjacent to the ith data line. Accordingly, by correcting the display data corresponding to the ith data line on the basis of the value of change in the display data corresponding to the data line adjacent to the ith data line and on the basis of the correction coefficient, voltage error caused by the coupling between the ith data line and the data line adjacent thereto can be corrected appropriately.

According to another aspect of the invention, the correction circuit may carry out the correction process on the display data corresponding to the ith data line using a value obtained by multiplying the value of change with the correction coefficient.

The voltage error in the ith data line is a value obtained by multiplying the stated value of change with a coupling coefficient. Accordingly, voltage error caused by coupling between the ith data line and the data line adjacent thereto can be corrected appropriately by carrying out the correction process on the display data corresponding to the ith data line using a value obtained by multiplying the value of change with the correction coefficient.

According to another aspect of the invention, the ith data line driving circuit may have a capacitor driving circuit that outputs first to nth capacitor driving voltages (where n is a natural number of 2 or more) corresponding to the display data to first to nth capacitor driving nodes, and a capacitor circuit having first to nth capacitors provided between the first to nth capacitor driving nodes and a data voltage output terminal.

According to this aspect, the data voltage can be outputted through charge redistribution between a capacitance of the capacitor circuit and an electro-optical panel-side capacitance (parasitic capacitance among the data lines, for example). Through this, the driving can be carried out at higher speeds than with driving using an amplifier circuit or the like, and thus electro-optical panels having higher resolutions can be driven. Furthermore, using charge redistribution makes it possible to consume less power than with driving using an amplifier circuit or the like.

Another aspect of the invention relates to an electro-optical apparatus including any of the drivers described above and an electro-optical panel.

Still another aspect of the invention relates to an electronic device including any of the drivers described above.

BRIEF DESCRIPTION OF THE DRAWINGS

The invention will be described with reference to the accompanying drawings, wherein like numbers reference like elements.

FIG. 5A is a diagram illustrating data voltage error arising due to a coupling coefficient, and FIG. 5B is a diagram illustrating a correction process for correcting data voltage error caused by coupling capacitance.

DESCRIPTION OF EXEMPLARY EMBODIMENTS

Hereinafter, preferred embodiments of the invention will be described in detail. Note that the embodiments described hereinafter are not intended to limit the content of the invention as described in the appended claims in any way, and not all of the configurations described in these embodiments are required as the means to solve the problems as described above.

1. Driver and Electro-Optical Panel

Figure 1:
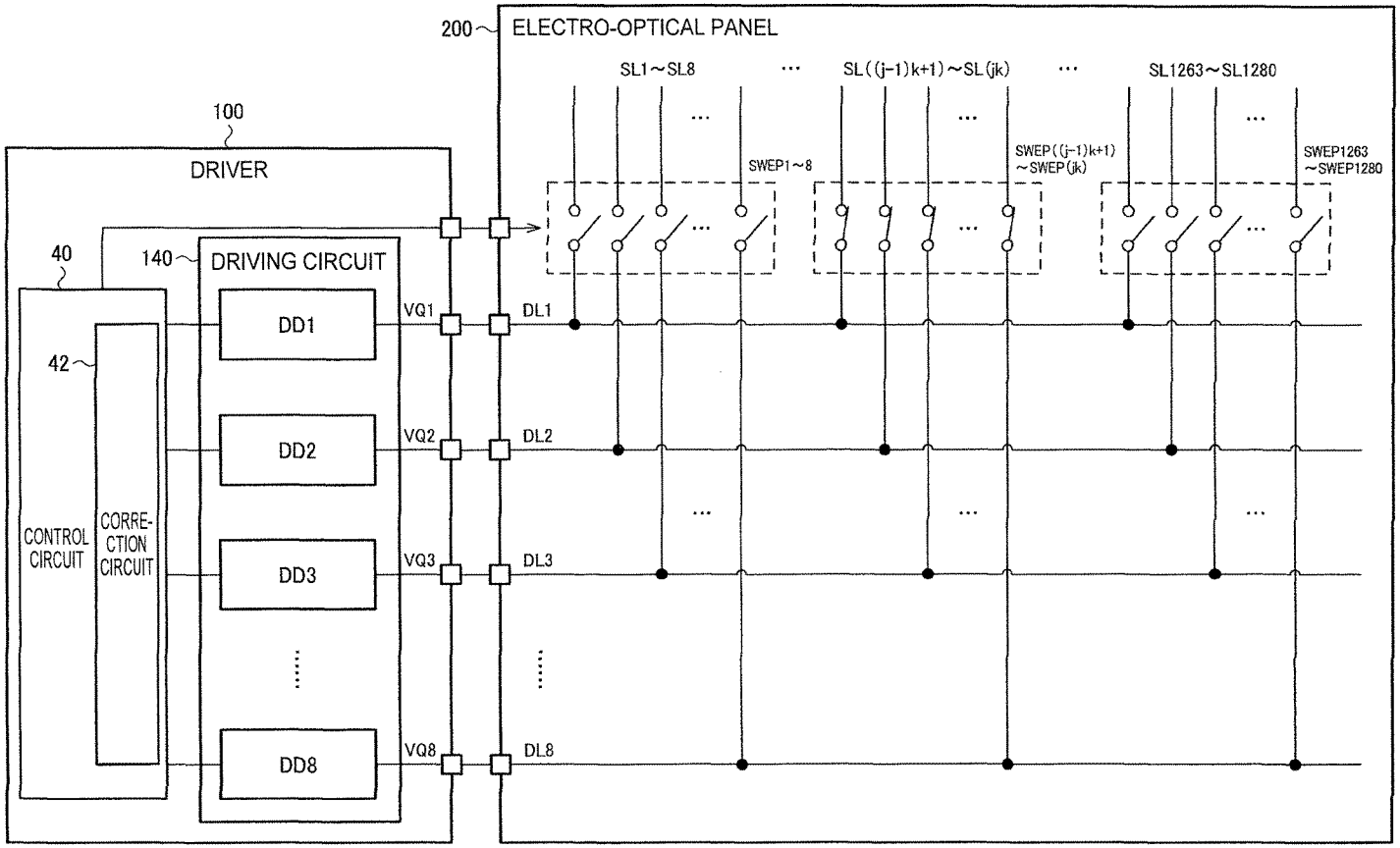
FIG. 1 illustrates an example of the configuration of a driver and an electro-optical panel.

FIG. 1 illustrates an example of the configuration of a driver and an electro-optical panel according to this embodiment. The following describes an example of phase expansion driving, but the method of driving carried out by the driver in this embodiment is not limited to phase expansion driving.

A driver 100 includes a control circuit 40 and a driving circuit 140. The control circuit 40 includes a correction circuit 42. The driving circuit 140 includes first to kth data line driving circuits DD1 to DDk (where k is a natural number of 2 or more). The following will describe an example in which k=8.

The control circuit 40 outputs corresponding display data (tone data) to each of the data line driving circuits DD1 to DD8. The control circuit 40 also outputs a control signal (for example, ENBX illustrated in FIG. 2 or the like) to an electro-optical panel 200. The control circuit 40 can be constituted by a logic circuit such as a gate array or the like, for example.

The correction circuit 42 corrects the display data and cancels out error in a data voltage arising due to coupling capacitance among data lines DL1 to DL8 of the electro-optical panel 200. This correction process will be described later.

The data line driving circuits DD1 to DD8 convert the display data into data voltages, and output those data voltages to the data lines DL1 to DL8 of the electro-optical panel 200 as output voltages VQ1 to VQ8.

The electro-optical panel 200 includes the data lines DL1 to DL8 (first to kth data lines), switching elements SWEP1 to SWEP(t×k), and source lines SL1 to SL(t×k). t is a natural number of 2 or more, and the following will describe an example in which t=160 (in other words, tk=160×8=1,280 (WXGA)).

Of the switching elements SWEP1 to SWEP1280, one end of each of the switching elements SWEP((j−1)×k+1) to SWEP(j×k) is connected to the data lines DL1 to DL8. j is a natural number no greater than t, which is 160. For example, in the case where j=1, the switching elements are SWEP1 to SWEP8.

The switching elements SWEP1 to SWEP1280 are constituted of TFTs (Thin Film Transistors) or the like, for example, and are controlled on the basis of control signals from the driver 100. For example, the electro-optical panel 200 includes a switching control circuit (not shown), and that switching control circuit controls the switching elements SWEP1 to SWEP1280 to turn on and off on the basis of a control signal such as ENBX.

Figure 2:
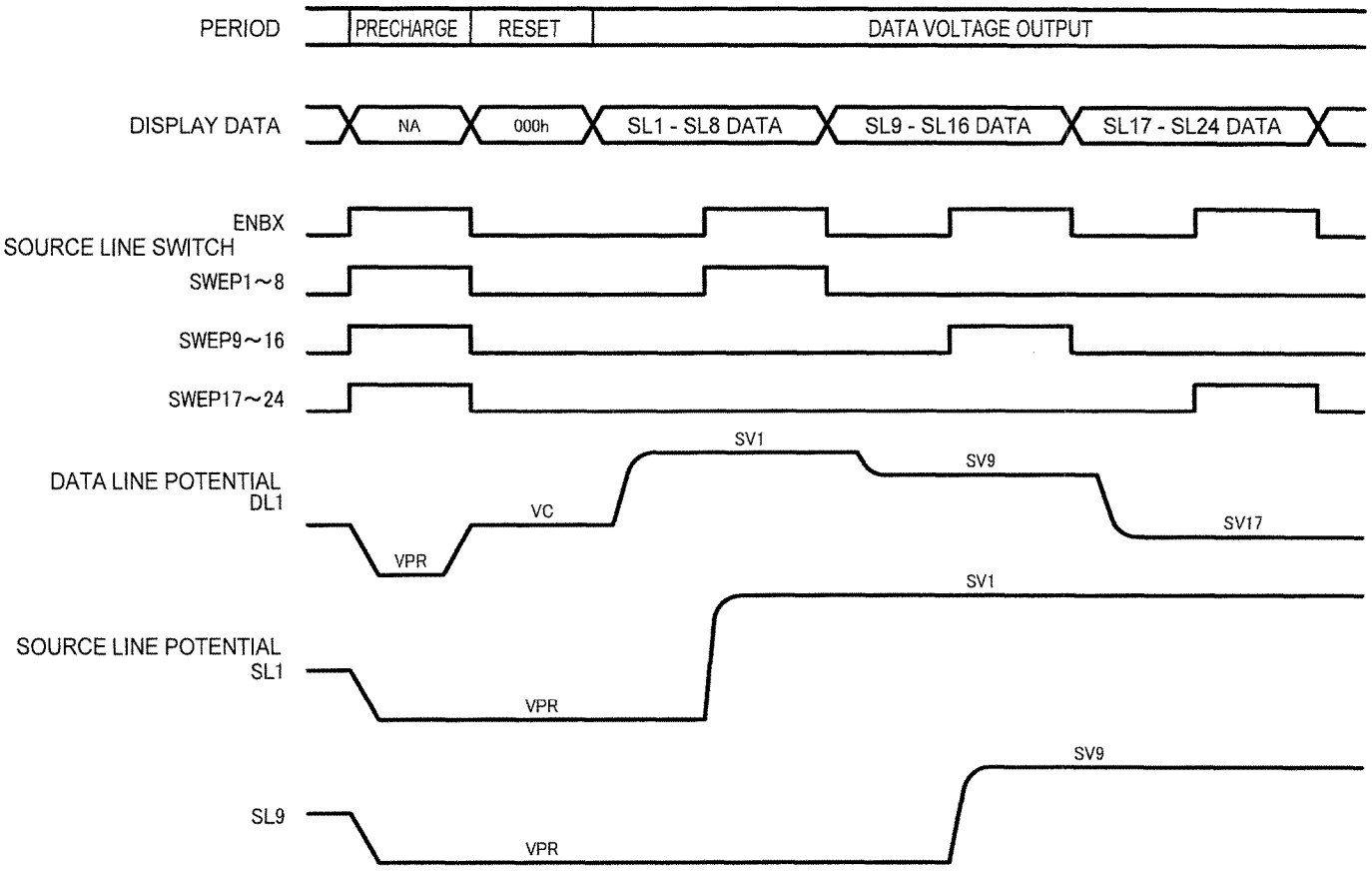
FIG. 2 is an operational timing chart of a driver and an electro-optical panel.

FIG. 2 is an operational timing chart of the driver 100 and the electro-optical panel 200 illustrated in FIG. 1.

In a precharge period, the signal ENBX goes to high-level (a first level), and all of the switching elements SWEP1 to SWEP1280 turn on. The data line driving circuits DD1 to DD8 output a precharge voltage VPR, and all of the source lines SL1 to SL1280 are set to the precharge voltage VPR.

In a reset period, the signal ENBX goes to low-level (a second level), and the switching elements SWEP1 to SWEP1280 all turn off. The data line driving circuits DD1 to DD8 then output a reset voltage VC, and the data lines DL1 to DL8 are set to the reset voltage VC. The source lines SL1 to SL1280 remain at the precharge voltage VPR.

In a first output period in a data voltage output period, the display data corresponding to the source lines SL1 to SL8 are inputted into the data line driving circuits DD1 to DD8. The data line driving circuits DD1 to DD8 then drive the data lines DL1 to DL8 with data voltages SV1 to SV8 through capacitive driving, which will be described later. After the capacitive driving starts, the signal ENBX goes to high-level, and the switching elements SWEP1 to SWEP8 turn on. Then, the source lines SL1 to SL8 are driven by the data voltages SV1 to SV8. At this time, a single gate line (horizontal scanning line) is selected by a gate driver (not shown), and the data voltages SV1 to SV8 are written into the pixel circuits connected to the selected gate line and the data lines DL1 to DL8. Note that FIG. 2 illustrates potentials of the data line DL1 and the source line SL1 as examples.

In a second output period, the display data corresponding to the source lines SL9 to SL16 are inputted into the data line driving circuits DD1 to DD8. The data line driving circuits DD1 to DD8 then drive the data lines DL1 to DL8 with data voltages SV9 to SV16 through capacitive driving. After the capacitive driving starts, the signal ENBX goes to high-level, and the switching elements SWEP9 to SWEP16 turn on. Then, the source lines SL9 to SL16 are driven by the data voltages SV9 to SV16. At this time, the data voltages SV9 to SV16 are written into the pixel circuits connected to the selected gate line and the data lines DL9 to DL16. Note that FIG. 2 illustrates potentials of the data line DL1 and the source line SL9 as examples.

Thereafter, the source lines SL17 to SL24, SL25 to SL32, . . . , and SL1263 to SL1280 are driven in the same manner in a third output period, a fourth output period, . . . , and a 160th output period, after which the process moves to the postcharge period.

2. Correction Circuit

Next, the correction process carried out by the correction circuit 42 will be described in detail. First, capacitive driving and data voltage error caused by coupling capacitance between data lines will be described.

Figure 8:
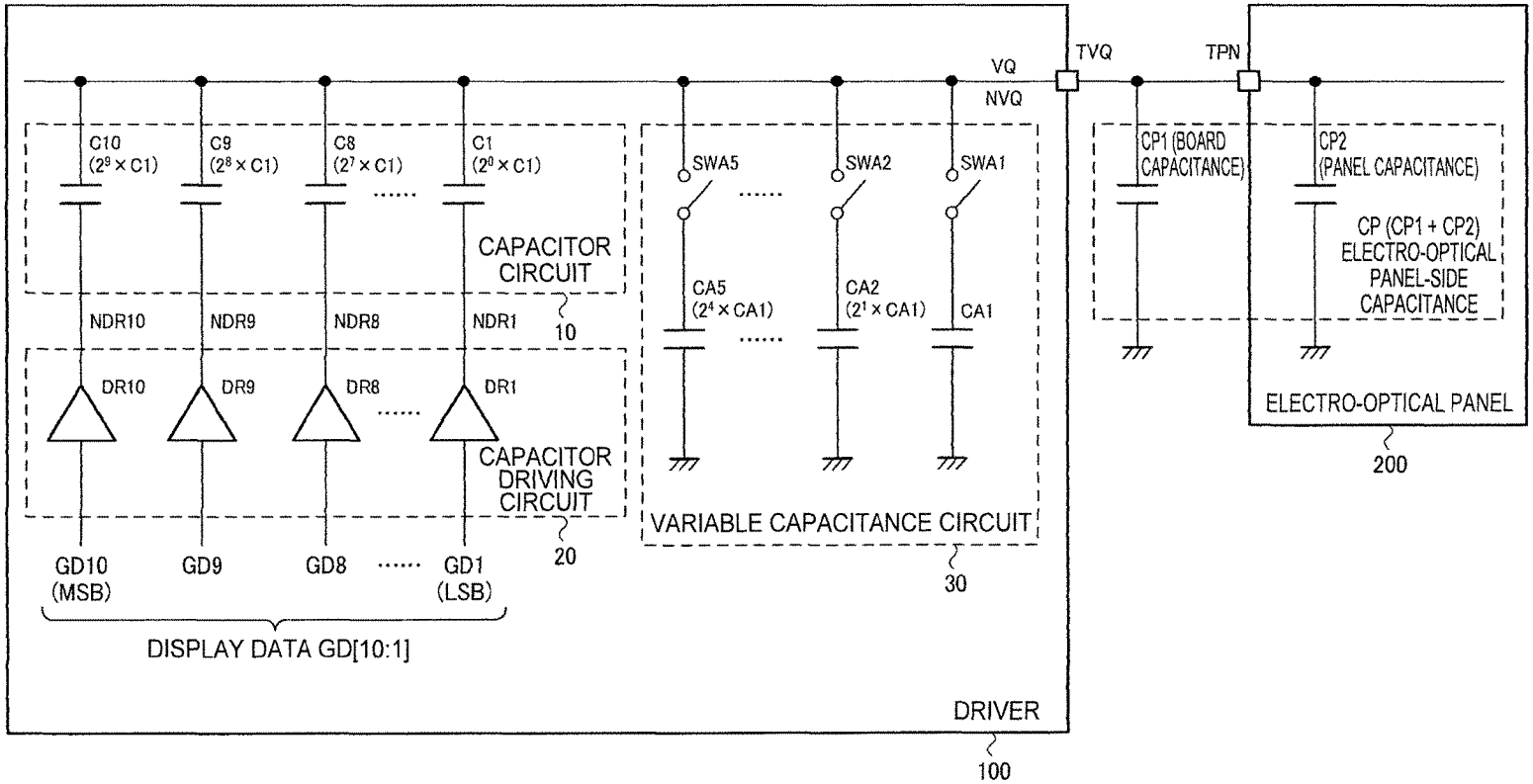
FIG. 8 illustrates a second example of the configuration of a driver.

Capacitive driving will be described later with reference to FIG. 8 and so on, and thus will only be described briefly here. As illustrated in FIG. 8, driving units DR1 to DR10 of a capacitor driving circuit 20 output one of two voltage values (0 V or 15 V) in accordance with display data GD[10:1]. Through this, a charge is redistributed between capacitors C1 to C10 of a capacitor circuit 10, a capacitance of a variable capacitance circuit 30, and an electro-optical panel-side capacitance CP, and a data voltage is outputted as a result. In the case where the capacitance of the capacitor circuit 10 is CO (=C1+C2+ . . . +C10) and the capacitance of the variable capacitance circuit 30 is CA, an adjustment is made so that CO:CP+CA=1:2. The variable capacitance circuit 30 is provided in order to adjust this ratio. In the case where the reset voltage VC is 7.5 V, the data voltage for display data GD[10:1] of "000h" to "3FFh" (h represents a hexadecimal) is 7.5 V to 12.5 V.

Figure 3:
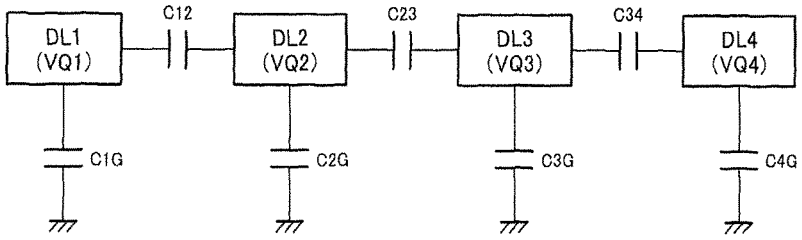
FIG. 3 is a schematic diagram illustrating coupling capacitances.

FIG. 3 is a schematic diagram illustrating coupling capacitances. It is assumed here that four data lines DL1 to DL4 (where k=4) are provided in the electro-optical panel.

Coupling capacitances C12, C23, and C24 are present between respective pairs of data lines. A coupling capacitance is parasitic capacitance arising between parallel interconnects, and interconnects are parallel on, for example, a glass substrate of an electro-optical panel or on a circuit board (a rigid board, a flexible board) that connects a driver to an electro-optical panel. Meanwhile, board capacitances C1G, C2G, C3G, and C4G are present between each data line and the board. "Board" refers to the glass substrate of an electro-optical panel, a circuit board, or the like, and the board capacitance arises between a fixed voltage line (a ground or the like, for example) of that board and the data lines.

Figure 4A:
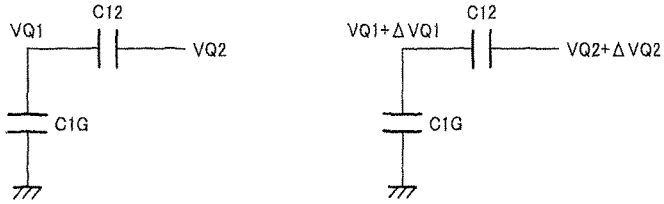
FIGS. 4A and 4B are diagrams illustrating data voltage coupling through coupling capacitance.

Coupling of data voltages caused by the stated coupling capacitance will be described using FIGS. 4A and 4B. The voltages of the data lines DL1 to DL4 are assumed to be VQ1 to VQ4. FIG. 4A is a diagram illustrating coupling of the data line DL2 to the data line DL1, and FIG. 4B is a diagram illustrating coupling of the data line DL1 and the data line DL3 to the data line DL2.

As illustrated in FIG. 4A, it is assumed that the voltage VQ2 of the data line DL2 has changed by voltage ΔVQ2. At this time, the voltage VQ1 of the data line DL1 changes by voltage ΔVQ1 due to charge conservation in the data line DL1, as indicated by Formula FA. A ratio between ΔVQ1 and ΔVQ2 is a coupling coefficient, and the coefficient is C12/(C12+C1G) in the coupling of the data line DL2 to the data line DL1.

Figure 4B:
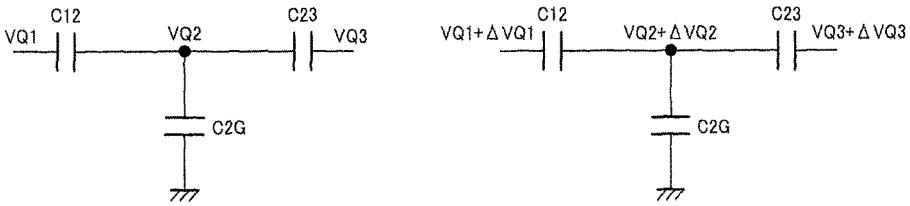

Meanwhile, as illustrated in FIG. 4B, it is assumed that the voltages VQ1 and VQ3 of the data lines DL1 and DL3 have changed by voltages ΔVQ1 and ΔVQ3. At this time, the voltage VQ2 of the data line DL2 changes by voltage ΔVQ2 due to charge conservation in the data line DL2, as indicated by Formula FB. A ratio between ΔVQ2 and ΔVQ1 and a ratio between ΔVQ2 and ΔVQ3 are coupling coefficients. The coefficient is C12/(C12+C23+C2G) in the coupling of the data line DL1 to the data line DL2. The coefficient is C23/(C12+C23+C2G) in the coupling of the data line DL3 to the data line DL2.

Although the coupling capacitance between the data line DL1 and the data line DL2 is C12, the coupling coefficient C12/(C12+C1G) of the data line DL2 to the data line DL1 and the coupling coefficient C12/(C12+C23+C2G) of the data line DL1 to the data line DL2 are different, as can be seen from Formula FA and Formula FB.

Error in the data voltage arising due to the stated coefficients will be described using FIG. 5A. A target voltage is a desired voltage to be outputted (a voltage corresponding to the original display data). A set voltage is a voltage corresponding to set display data (display data inputted to the capacitor driving circuit 20 illustrated in FIG. 8), and is a voltage not including the effects of coupling. A resulting voltage is a voltage including the effects of coupling that is ultimately outputted to the data line.

Assume that, with respect to the target voltage of 100 mV of the data line DL1, a set voltage of the same 100 mV has been set. Assume also that the coupling coefficient of the data line DL2 to the data line DL1 (the Formula FA in FIG. 4A) is 0.25, and the voltage of the data line DL2 has changed from 0 mV to 100 mV. At this time, the resulting voltage of the data line DL1 including the effects of the coupling is 100 mV+0.25×100 mV=125 mV.

Meanwhile, assume that, with respect to the target voltage of 100 mV of the data line DL2, a set voltage of the same 100 mV has been set, which is the same 100 mV. Assume also that the coupling coefficient of the data line DL1 to the data line DL2 is 0.2, the coupling coefficient of the data line DL3 to the data line DL2 is 0.3 (Formula FB in FIG. 4B), and the voltages of the data lines DL1 and 3 have changed from 0 mV to 100 mV. At this time, the resulting voltage of the data line DL2 including the effects of the coupling is 100 mV+0.2×100 mV+0.3×100 mV=150 mV.

As described above, the voltages VQ1 and VQ2 of the data lines DL1 and DL2 include errors of 25 mV and 50 mV, relative to the target voltage of 100 mV, caused by coupling capacitance, and the resulting voltages are 125 mV and 150 mV. Likewise, the voltages of the data lines DL3 and DL4 include errors of 54 mV and 10 mV, relative to the target voltage of 100 mV, caused by coupling capacitance, and the resulting voltages are 154 mV and 110 mV. The error is obtained by multiplying the voltage change in the adjacent data line (for example, DL2 relative to DL1) by the coefficient, and therefore depends on the voltage change in the adjacent data line. When pixels are driven in order, the data voltage changes in accordance with that driving, and thus data voltage error arises in response to the voltage change in the adjacent data line at that time.

In this embodiment, such data voltage error caused by coupling capacitance can be corrected by the correction circuit 42 correcting the display data. This correction process will be described using FIG. 5B.

As illustrated in FIG. 5B, the correction circuit 42 sets a set voltage of 75 mV relative to the target voltage of 100 mV of the data line DL1, in anticipation of an error of 25 mV. Specifically, because the error of 25 mV is 0.25×100 mV, the correction circuit 42 subtracts 0.25×100 mV from the target voltage of 100 mV to find the set voltage of 75 mV (=100 mV-0.25×100 mV). 0.25 is a correction coefficient, and is the aforementioned coupling coefficient. The correction circuit 42 then outputs the set voltage of 75 mV to the data line driving circuit DD1. When the voltage of the data line DL2 has changed from 0 mV to 100 mV, the resulting voltage of the data line DL1 including the effects of coupling is 75 mV+0.25×100 mV=100 mV, which matches the target voltage of 100 mV.

Although the foregoing describes voltage, the correction circuit 42 actually carries out the correction process on the display data. In other words, the present display data of the data line DL2 is subtracted from the previous display data, the obtained difference is multiplied by the coefficient of 0.25, the present display data of the data line DL1 is subtracted from the obtained product, and that corrected display data is outputted to the data line driving circuit DD1. For example, in FIG. 1, the previous display data of the data line DL2 is the display data used when driving the source line SL2, the present display data of the data line DL2 is the display data used when driving the source line SL10, and the present display data of the data line DL1 is the display data used when driving the source line SL9.

Although FIG. 5B illustrates a case where the change in the voltage of the data line DL2 is positive, the same applies in the case where the change is negative. For example, in the case where the voltage of the data line DL2 has changed from 100 mV to 0 mV, the voltage change is −100 mV. In this case, the set voltage is 100 mV-0.25×(−100 mV)=125 mV. The resulting voltage of the data line DL1 including the effects of coupling is 125 mV+0.25×(−100 mV)=100 mV, which matches the target voltage of 100 mV.

The same applies to the data lines DL2, DL3, and DL4, where errors of 50 mV, 54 mV, and 10 mV are subtracted from the target voltage of 100 mV, and the set voltages of 50 mV, 46 mV, and 90 mV are outputted to the data line driving circuits DD2, DD3, and DD4. The resulting voltages of the data lines DL2, DL3, and DL4 including the effects of coupling are 100 mV, which match the target voltage of 100 mV.

3. Method of Measuring Correction Coefficient

A method of measuring the correction coefficient (coupling coefficient) used in the correction process will be described next. As described above, the correction value is obtained by multiplying the correction coefficient with the change in the data voltage (the change in the display data), and because the change in the data voltage can be known from the display data, it is necessary to determine the correction coefficient in advance.

Figure 6:
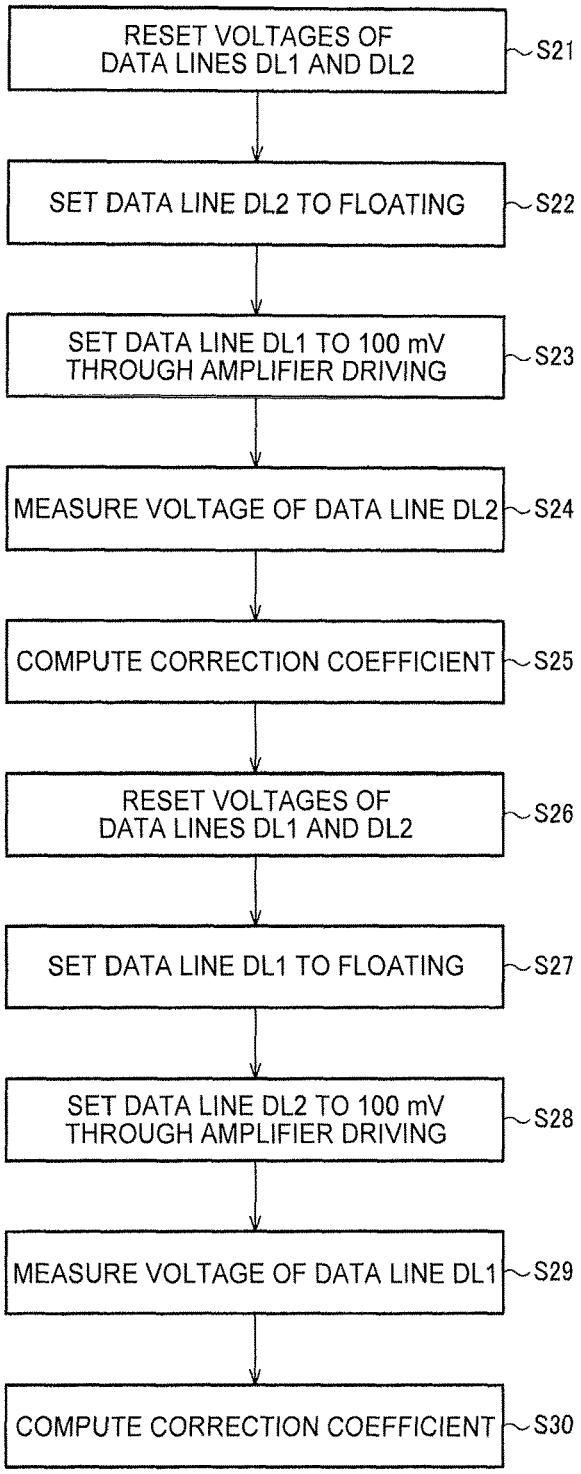
FIG. 6 is a flowchart illustrating a correction coefficient measurement process.

FIG. 6 is a flowchart illustrating a correction coefficient measurement process. FIG. 6 is a flowchart illustrating a process for measuring the correction coefficient between the data lines DL1 and DL2. Note that the correction coefficient between the data lines DL2 and DL3, the correction coefficient between the data lines DL3 and DL4, and so on up to the correction coefficient between the data lines DL7 and DL8 can be determined in the same manner.

First, the correction coefficient for correcting the voltage error caused by coupling of the data line DL1 to the data line DL2 is measured. In other words, the voltages of the data lines DL1 and DL2 are set to the reset voltage VC (a tone "0") (step S21). The reset voltage VC is supplied from a voltage generating circuit, for example, a switching element is provided between the output of the voltage generating circuit and the output of the data line driving circuit, and the reset voltage VC is outputted to the data line (from a data voltage output terminal) by turning the switching element on.

Next, the data line DL2 is put into a floating state (step S22). The floating state is a state in which a charge at that node is conserved, and a state in which no charge is supplied to the node, no charge flows from the node, and so on. Specifically, this is a state in which the data line DL2 is not being driven by an amplifier circuit AMVD described later with reference to FIG. 10 (that is, in which a switching circuit SWAM is off).

Next, the voltage of the data line DL1 is set to VC+100 mV through voltage driving (step S23). In other words, the voltage of the data line is changed from VC to VC+100 mV. Voltage driving is driving of the data line DL2 by the amplifier circuit AMVD (a state in which the switching circuit SWAM is on).

Next, the voltage of the data line DL2 is measured (step S24). The voltage measurement is carried out by a measurement circuit 120, for example, described later with reference to FIG. 7. Alternatively, the voltage measurement may be carried out by a measurement circuit outside the driver (a tester used for manufacturing tests, pre-shipping tests, and so on, or a measurement circuit mounted on a circuit board).

Next, the correction coefficient for correcting the voltage error caused by coupling of the data line DL1 to the data line DL2 is computed (step S25). Assuming that VC+120 mV has been measured as the voltage of the data line DL2 in step S24, an error of 20 mV is obtained. Because the error is 20 mV relative to the voltage change of 100 mV in the data line DL1, the correction coefficient is determined as 20 mV/100 mV=0.20.

Next, the correction coefficient for correcting the voltage error caused by coupling of the data line DL2 to the data line DL1 is measured in the same manner. In other words, the voltages of the data lines DL1 and DL2 are set to the reset voltage VC (a tone "0") (step S26). Next, the data line DL1 is put into a floating state (step S27). Next, the voltage of the data line DL2 is set to VC+100 mV through voltage driving (step S28). Next, the voltage of the data line DL1 is measured (step S29). Next, the correction coefficient for correcting the voltage error caused by coupling of the data line DL2 to the data line DL1 is computed (step S30). Assuming that VC+125 mV has been measured as the voltage of the data line DL1, an error of 25 mV is obtained. Because the error is 25 mV relative to the voltage change of 100 mV in the data line DL2, the correction coefficient is determined as 25 mV/100 mV=0.25.

The correction coefficient measured in this manner is stored in, for example, a register provided in the driver (a register unit 48 illustrated in FIG. 10), a non-volatile memory such as an OTP (not shown), or the like. The measurement of the correction coefficient is carried out, for example, when power to the driver is turned on (during a system or driver IC reset), or the like. In this case, the coefficient is stored in the register or the like. Alternatively, the coefficient measurement is carried out in a manufacture or pre-shipping test. In this case, the coefficient may be stored in a non-volatile memory or the like, or the coefficient may be stored in a processing unit outside the driver (a CPU or the like) and written into the register or the like of the driver from the processing unit when power to the driver is turned on.

Figure 7:
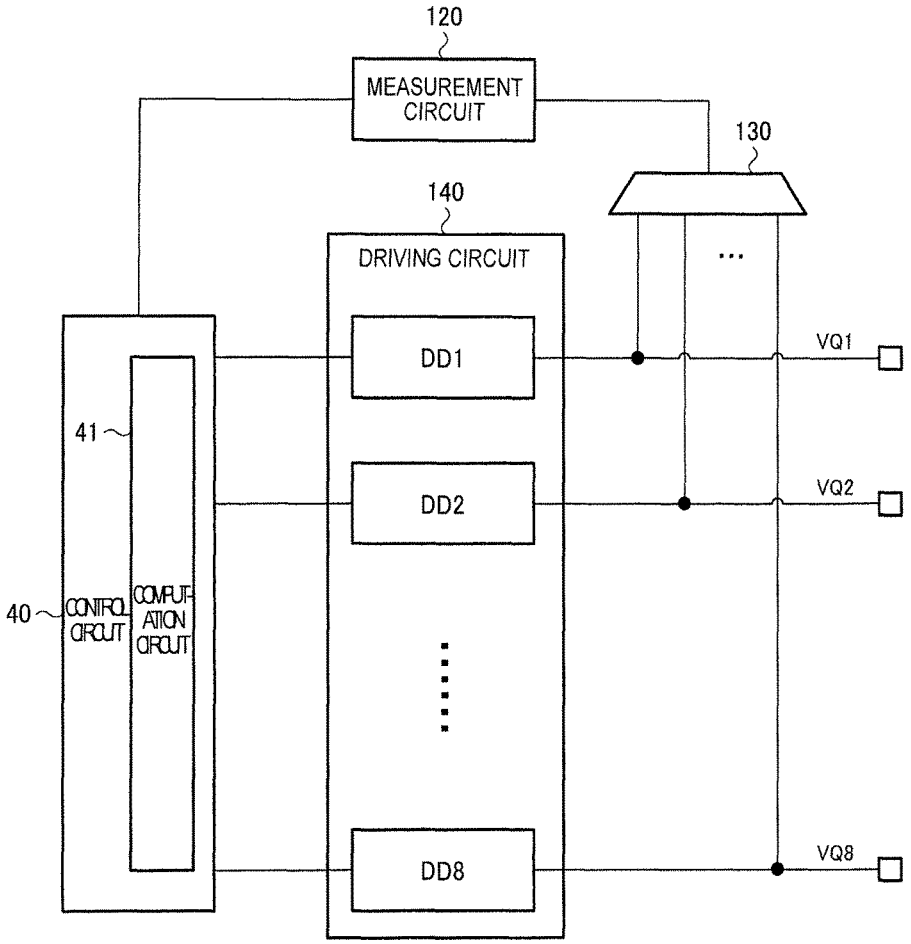
FIG. 7 illustrates an example of the configuration of a driver in the case where a measurement circuit is provided within the driver.

FIG. 7 illustrates an example of the configuration of a driver in the case where the measurement circuit is provided within the driver. The driver includes the control circuit 40, the driving circuit 140, the measurement circuit 120, and a selector 130. The control circuit 40 includes a computation circuit 41.

The selector 130 selects the output of the data line driving circuit to be measured. For example, in the case where the voltage VQ1 of the data line DL1 is to be measured, the selector 130 selects the output of the data line driving circuit DD1 and outputs the voltage VQ1. The selector 130 is constituted of a switching element, for example. The measurement circuit 120 measures the voltage of the data line selected by the selector 130. The measurement circuit 120 is constituted of an A/D conversion circuit, a voltage comparison circuit, or the like, for example. A result of measuring the voltage is outputted as an A/D conversion value, a voltage comparison result, or the like, for example. The computation circuit 41 finds the correction coefficient (coupling coefficient) on the basis of the measurement result from the measurement circuit 120, and stores that correction coefficient in a storage unit such as a register or the like. The process for computing the correction coefficient is as described in steps S25 and S30 of FIG. 6.

According to the embodiment described thus far, the driver 100 includes the driving circuit 140, which has the first to eighth data line driving circuits DD1 to DD8 that drive the first to eighth data lines DL1 to DL8 of the electro-optical panel 200, the measurement circuit 120, which measures the voltages of the first to eighth data lines DL1 to DL8, and the computation circuit 41, which computes the correction coefficient for correcting the display data GD[10:1]. On the basis of a measurement result from the measurement circuit 120, the computation circuit 41 computes the correction coefficient (0.2, 0.25, and so on in FIG. 5B) that changes in accordance with the coupling capacitance (C12 and so on in FIG. 3) between the ith data line DLi and the data lines DLi−1 and DLi+1 adjacent to the ith data line DLi.

By doing so, the correction coefficient based on the coupling capacitance between the ith data line DLi and the data lines DLi−1 and DLi+1 adjacent to the ith data line DLi can be found as the correction coefficient for correcting the display data supplied to the ith data line driving circuit DDi. This makes it possible to correct the display data supplied to the ith data line driving circuit DDi using the correction coefficient, which in turn makes it possible to correct errors in the data voltage caused by coupling between data lines, as described with reference to FIG. 4A and so on. In other words, because coupling occurs between parallel interconnects, such coupling becomes particularly great between adjacent data lines. Accordingly, data voltage error can be corrected appropriately by carrying out the correction process using the correction coefficient based on the coupling capacitance with the adjacent data lines.

In addition, in this embodiment, the computation circuit 41 changes the display data supplied to an i+1th data line driving circuit DDi+1 from first display data to second display data (steps S26 and S28 in FIG. 6). The measurement circuit 120 then measures the amount of the change of the voltage of the ith data line DLi. On the basis of that amount of change in the voltage, the computation circuit 41 computes the correction coefficient (0.25 for DL2→DL1 in FIG. 5B) based on the coupling capacitance (C12) between the ith data line DLi and the i+1th data line DLi+1.

As described with reference to FIGS. 4A, 4B, and the like, voltage error in the ith data line DLi (ΔVQ1 in Formula FA and ΔVQ2 in Formula FB) is proportional to the value of the change in the display data corresponding to the data lines DLi−1 and DLi+1 adjacent to the ith data line DLi (data voltage change values; ΔVQ2 in Formula FA and ΔVQ1 and ΔVQ3 in Formula FB). Accordingly, a proportionality coefficient can be found for the change value of the display data by changing the display data supplied to the i+1th data line driving circuit DDi+1 from the first display data to the second display data and measuring the amount of change in the voltage of the ith data line DLi. Data voltage error caused by coupling can then be corrected appropriately by carrying out the correction process using that proportionality coefficient as the correction coefficient.

In addition, in this embodiment, when the computation circuit 41 changes the display data supplied to the i+1th data line driving circuit DDi+1 from the first display data to the second display data, the ith data line driving circuit DDi sets the ith data line DLi to a state in which the charge of the ith data line DLi is conserved (a floating state) (step S27 in FIG. 6).

In the case where charges are inputted and outputted through amplifier driving or the like, the data line voltage is determined by amplifier circuit driving instead of charge redistribution, and thus voltage error caused by coupling cannot be measured correctly. As such, setting the ith data line DLi to a state in which the charge of the ith data line DLi is conserved during voltage measurement makes it possible to measure voltage error caused by coupling under the same conditions as when carrying out capacitive driving.

Meanwhile, in this embodiment, the correction coefficient is a correction coefficient based on a ratio of the coupling capacitance (C12 in Formula FA and C12 and C23 in Formula FB) to the overall capacitance of the ith data line DLi ((C12+C1G) in Formula FA and (C12+C23+C2G) in Formula FB).

As described with reference to FIG. 4A and the like, a change in the voltage of the ith data line DLi (ΔVQ1 in Formula FA, for example) is proportional to the ratio of the coupling capacitance (C12 in Formula FA) to the overall capacitance of the ith data line DLi ((C12+C1G) in Formula FA). Accordingly, by finding the correction coefficient based on that ratio, voltage error caused by coupling with the adjacent data lines DLi−1 and DLi+1 can be corrected appropriately.

In addition, in this embodiment, the correction coefficient includes a first correction coefficient based on a first coupling capacitance between the ith data line DLi and the i−1th data line DLi−1, and a second correction coefficient based on a second coupling capacitance between the ith data line DLi and the i+1th data line DLi+1.

For example, in FIG. 5B, the first correction coefficient based on the first coupling capacitance between the second data line DL2 and the first data line DL1 is 0.2, and the second correction coefficient based on the second coupling capacitance between the second data line DL2 and the third data line DL3 is 0.3.

As described with reference to FIG. 4B and the like, the change in the voltage of the ith data line DLi (ΔVQ2 in Formula FB, for example) includes a first term proportional with the first coupling capacitance (C12) between the ith data line DLi and the i−1th data line DLi−1 and a second term proportional with the second coupling capacitance (C23) between the ith data line DLi and the i+1th data line DLi+1. Accordingly, voltage error caused by coupling with the adjacent data lines DLi−1 and DLi+1 can be corrected appropriately by finding the first correction coefficient based on the first coupling capacitance (C12) and the second correction coefficient based on the second coupling capacitance (C23).

In addition, in this embodiment, the first correction coefficient is a correction coefficient based on a ratio of the first coupling capacitance (C12 in Formula FB) to the overall capacitance of the ith data line DLi ((C12+C23+C2G) in Formula FB). The second correction coefficient is a correction coefficient based on a ratio of the second coupling capacitance (C23 in Formula FB) to the overall capacitance of the ith data line DLi ((C12+C23+C2G) in Formula FB).

As described with reference to FIG. 5B and the like, the change in the voltage of the ith data line DLi (ΔVQ2 in Formula FB, for example) includes the first term and the second term. The first term is proportional to a ratio of the first coupling capacitance (C12 in Formula FB) to the overall capacitance of the ith data line DLi ((C12+C23+C2G) in Formula FB). The second term is proportional to a ratio of the second coupling capacitance (C23 in Formula FB) to the overall capacitance of the ith data line DLi ((C12+C23+C2G) in Formula FB). Accordingly, by finding the first correction coefficient and the second correction coefficient based on that ratio, voltage error caused by coupling with the adjacent data lines DLi−1 and DLi+1 can be corrected appropriately.

In addition, in this embodiment, the ith data line driving circuit DDi sets the ith data line DLi to a data voltage corresponding to the display data by controlling the amount of the charge supplied to the ith data line DLi.

In this embodiment, the data voltage is outputted through charge redistribution among the capacitance of the capacitor circuit 10, the capacitance of the variable capacitance circuit 30, and the capacitance of the electro-optical panel 200, as illustrated in FIG. 8. In other words, by the capacitor driving circuit 20 driving the capacitor circuit 10 in accordance with the display data GD[10:1], charges are redistributed by outputting a charge from the capacitor circuit 10 to the variable capacitance circuit 30 and the electro-optical panel 200 and by accumulating that supplied charge in the capacitance of the variable capacitance circuit 30 and the capacitance of the electro-optical panel 200. The amount of the charge outputted from the capacitor circuit 10 is a charge amount corresponding to the display data GD[10:1], and the data line is set to a data voltage corresponding to the display data GD[10:1] as a result of the charge redistribution, as will be described later with reference to FIG. 9B and the like.

According to such a driving method, a charge of a set amount corresponding to the display data GD[10:1] is outputted, rather than a charge being freely inputted and outputted in accordance with an output voltage, as with an amplifier circuit or the like. Accordingly, the charge distribution changes due to the coupling capacitance and the data voltage changes as well. As will be described later with reference to FIG. 8, a capacitance ratio for the charge redistribution is adjusted by the variable capacitance circuit 30, but because data voltage error caused by coupling capacitance depends on the change in the data voltage of the data line as described with reference to FIG. 4A and the like, the adjustment cannot be made using the variable capacitance circuit 30. With respect to this point, in this embodiment, the data voltage error caused by coupling capacitance can be corrected by the correction circuit 42 correcting the display data GD[10:1] using the correction coefficient based on the coupling capacitance.

Note that the correction process according to this embodiment is not limited to capacitive driving applications, and can be applied in any driving that controls the amount of the charge supplied to the ith data line DLi. A driving method in which, for example, a switching element having a variable driving capability (a transistor) is provided between a power source and the data voltage output terminal, the driving capability is changed in accordance with the display data, and the switching element is turned on for a predetermined period to supply a charge from the power source to the data line, can be considered as such a driving method. According to this method, the period for which the switching element is on is constant, and thus the charge amount varies in accordance with the driving capability. A charge of a set amount corresponding to the display data is outputted in such a method as well, and thus data voltage error caused by coupling capacitance can be corrected by carrying out the correction process according to this embodiment.

In addition, in this embodiment, the driver 100 includes the correction circuit 42 that carries out the correction process on the display data GD[10:1] and supplies the corrected display data to the driving circuit 140. The correction circuit 42 then supplies, to the ith data line driving circuit DDi, display data corrected with a correction coefficient (0.2, 0.25, and so on in FIG. 5B) based on coupling capacitances (C12 and the like in FIG. 3) between an ith data line DLi and data lines DLi−1 and DLi+1 adjacent to the ith data line DLi.

By doing so, the display data supplied to the ith data line driving circuit DDi can be corrected using the correction coefficient based on the coupling capacitance between the ith data line DLi and the data lines DLi−1 and DLi+1 adjacent to the ith data line DLi. This makes it possible to correct errors in the data voltage caused by coupling between data lines, as described with reference to FIG. 4A and so on. In other words, because coupling occurs between parallel interconnects, such coupling becomes particularly great between adjacent data lines. Accordingly, data voltage error can be corrected appropriately by carrying out the correction process using the correction coefficient based on the coupling capacitance with the adjacent data lines.

In addition, in this embodiment, the correction circuit 42 carries out the correction process on the display data corresponding to the ith data line DLi on the basis of the value of a change in the display data corresponding to the data lines DLi−1 and DLi+1 adjacent to the ith data line DLi (the target voltage of 100 mV for DL1 and DL3 in FIG. 5B) and the correction coefficient (0.2 for DL1→DL2 and 0.3 for DL3→DL2).

As described with reference to FIGS. 4A, 4B, and the like, voltage error in the ith data line DLi (ΔVQ1 in Formula FA and ΔVQ2 in Formula FB) is proportional to the value of the change in the display data corresponding to the data lines DLi−1 and DLi+1 adjacent to the ith data line DLi (data voltage change values; ΔVQ2 in Formula FA and ΔVQ1 and ΔVQ3 in Formula FB). Accordingly, voltage error caused by coupling can be corrected appropriately by carrying out the correction process on the display data corresponding to the ith data line DLi on the basis of the values of change in the display data corresponding to the data lines DLi−1 and DLi+1 adjacent to the ith data line DLi and the correction coefficient.

In addition, in this embodiment, the correction circuit 42 carries out the correction process on the display data corresponding to the ith data line DLi using a value obtained by multiplying the stated change value by the correction coefficient (in FIG. 5B, the correction value for DL2, for example, is 100 mV×0.2+100 mV×0.3=50 mV).

As described with reference to FIGS. 4A, 4B, and the like, the voltage error in the ith data line DLi (ΔVQ1 in Formula FA and ΔVQ2 in Formula FB) is a value obtained by multiplying the change value (ΔVQ2 in Formula FA and ΔVQ1 and ΔVQ3 in Formula FB) by the coupling coefficient. Accordingly, voltage error caused by coupling can be corrected appropriately by carrying out the correction process on the display data corresponding to the ith data line DLi using a value obtained by multiplying the change value with the correction coefficient.

Note that the multiplication is not limited to simple multiplication, and any process that at least includes multiplication may be employed; for example, the process may include addition, subtraction, division, and so on in addition to multiplication.

In addition, in this embodiment, the driver 100 includes a storage unit that stores the correction coefficient. The correction circuit 42 carries out the correction process on the display data GD[10:1] on the basis of the correction coefficient stored in the storage unit.

Figure 11:
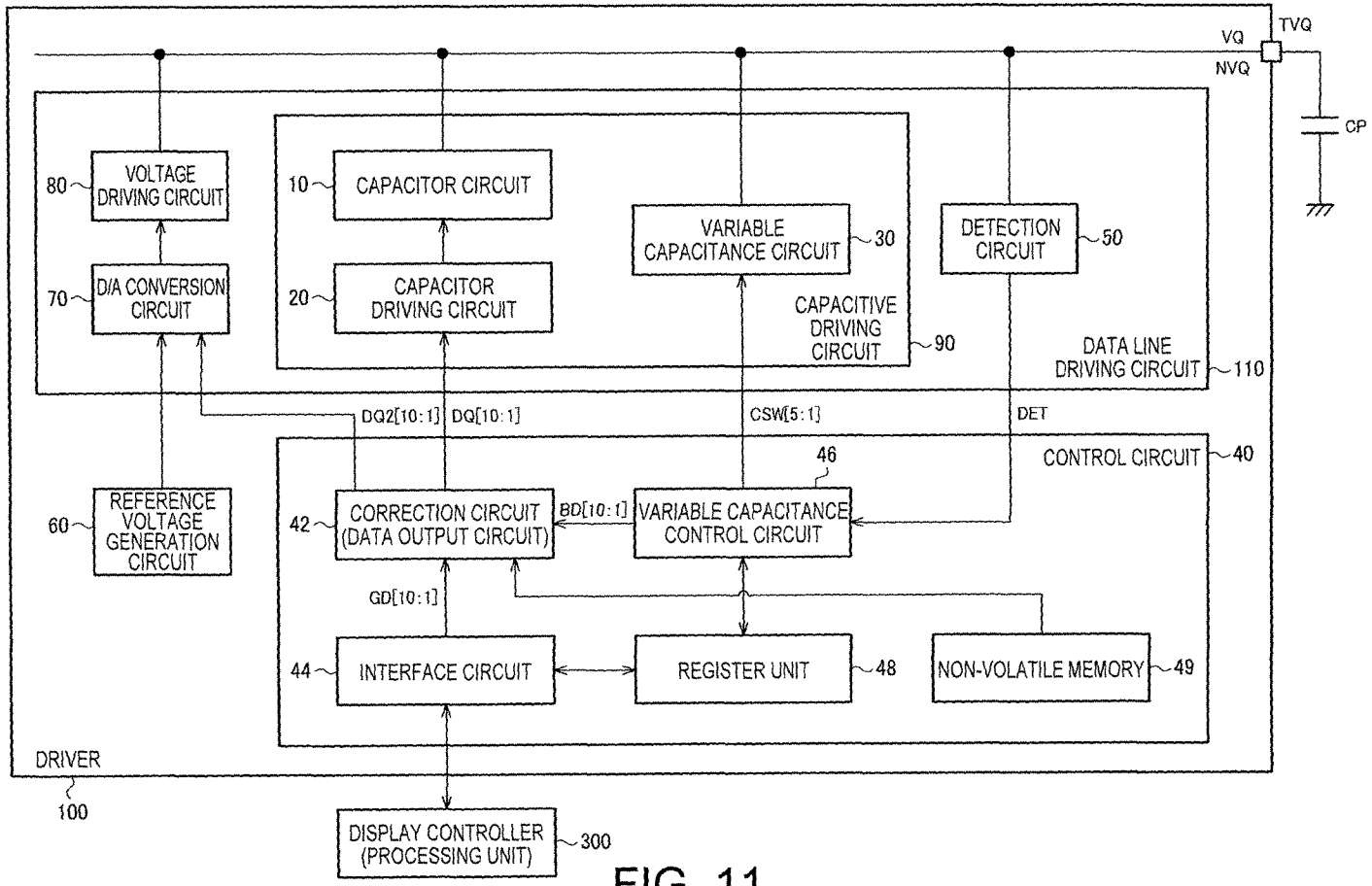
FIG. 11 illustrates an example of the detailed configuration of a driver.

The storage unit corresponds to the register unit 48, a non-volatile memory 49, or the like, illustrated in FIG. 11, for example. The storage unit may instead be a volatile memory such as a RAM or the like, a fuse set to a given value through processing at the time of inspection, or the like.

By including a storage unit in the driver 100, a correction coefficient measured by the measurement circuit 120 within the driver 100 or a correction coefficient measured by a tester or the like outside the driver 100 can be stored, and voltage error caused by coupling capacitance can be corrected using the stored correction coefficient. For example, in the case of a configuration where the measured correction coefficient is stored when power to the driver 100 is turned on, it is possible to handle changes in the voltage error over time occurring after the driver 100 was manufactured, changes in the voltage error due to changes in the environment such as temperature, and so on.

In addition, in this embodiment, the correction circuit 42 carries out the correction process on the display data corresponding to the ith data line DLi on the basis of a first change value that is a change value of the display data corresponding to the i−1th data line DLi−1 (the target voltage of 100 mV for DL1 in FIG. 5B), the first correction coefficient (0.2 for DL1→DL2), a second change value that is a change value of the display data corresponding to the i+1th data line DLi+1 (the target voltage of 100 mV for DL3), and the second correction coefficient (0.3 for DL3→DL2).

In addition, in this embodiment, the correction circuit 42 carries out the correction process on the display data corresponding to the ith data line DLi using a value obtained by finding the sum (50 mV) of the product of the first change value and the first correction coefficient (100 mV×0.2) to the product of the second change value and the second correction coefficient (100 mV×0.3).

As described with reference to FIG. 4B and the like, the voltage error of the ith data line DLi (ΔVQ2 in Formula FB) is a value obtained by adding the product of the first change value (ΔVQ1 in Formula FB) and the first coupling coefficient to the product of the second change value (ΔVQ3 in Formula FB) and the second coupling coefficient. Accordingly, voltage error caused by coupling can be corrected appropriately by carrying out the correction process on the display data corresponding to the ith data line DLi using the value obtained by adding the product of the first change value and the first correction coefficient to the product of the second change value and the second correction coefficient.

Note that the addition is not limited to simple addition, and any process that at least includes addition may be employed; for example, the process may include subtraction, multiplication, division, and so on in addition to addition.

4. Second Example of Configuration of Driver

FIG. 8 illustrates a second example of the configuration of a driver according to this embodiment. This driver 100 includes the capacitor circuit 10, the capacitor driving circuit 20, the variable capacitance circuit 30, and a data voltage output terminal TVQ. Although FIG. 8 illustrates a configuration corresponding to a single data line driving circuit, in reality, a plurality of data line driving circuits are provided, as illustrated in FIG. 1. Note that in the following, the same sign as a sign for a capacitor is used as a sign indicating a capacitance value of that capacitor.

The driver 100 is constituted by an integrated circuit (IC) device, for example. The integrated circuit device corresponds to an IC chip in which a circuit is formed on a silicon substrate, or a device in which an IC chip is held in a package, for example. Terminals of the driver 100 (the data voltage output terminal TVQ and so on) correspond to pads or package terminals of the IC chip.

The capacitor circuit 10 includes first to nth capacitors C1 to Cn (where n is a natural number of 2 or more). The capacitor driving circuit 20 includes first to nth driving units DR1 to DRn. Although the following describes a case where n=10 as an example, n may be any natural number greater than or equal to 2. For example, n may be set to the same number as the bit number of the display data.

One end of an ith capacitor in the capacitors C1 to C10 (where i is a natural number no greater than n, which is 10) is connected to a capacitor driving node NDRi, and another end of the ith capacitor is connected to a data voltage output node NVQ. The data voltage output node NVQ is a node connected to the data voltage output terminal TVQ. The capacitors C1 to C10 have capacitance values weighted by a power of 2. Specifically, the capacitance value of the ith capacitor Ci is $2^{(i-1)}$×C1.

An ith bit GDi of the display data GD[10:1] (tone data) is inputted into an input node of an ith driving unit DRi of the first to tenth driving units DR1 to DR10. An output node of the ith driving unit DRi corresponds to the ith capacitor driving node NDRi. The display data GD[10:1] is constituted of first to tenth bits GD1 to GD10 (first to nth bits), where the bit GD1 corresponds to the LSB and the bit GD10 corresponds to the MSB.

The ith driving unit DRi outputs a first voltage level in the case where the bit GDi is at a first logic level and outputs a second voltage level in the case where the bit GDi is at a second logic level. For example, the first logic level is 0 (low-level), the second logic level is 1 (high-level), the first voltage level is a voltage at a low-potential side power source VSS (0 V, for example), and the second voltage level is a voltage at a high-potential side power source VDD (15 V, for example). For example, the ith driving unit DRi is constituted of a level shifter that level-shifts the inputted logic level (a 3 V logic power source, for example) to the output voltage level (15 V, for example) of the driving unit DRi, a buffer circuit that buffers the output of that level shifter, and so on.

As described above, the capacitance values of the capacitors C1 to C10 are weighted by a power of 2 that is based on the order of the bits GD1 to GD10 in the display data GD[10:1]. The driving units DR1 to DR10 output 0 V or 15 V in accordance with the bits GD1 to GD10, and the capacitors C1 to C10 are driven by those voltages. As a result of this driving, charge redistribution occurs between the capacitors C1 to C10, the capacitance of the variable capacitance circuit 30, and an electro-optical panel-side capacitance CP, and a data voltage is output to the data voltage output terminal TVQ as a result.

The electro-optical panel-side capacitance CP is the sum of capacitances as viewed from the data voltage output terminal TVQ. For example, the electro-optical panel-side capacitance CP is a result of adding a board capacitance CP1 that is parasitic capacitance of a printed circuit board with a panel capacitance CP2 that is parasitic capacitance, pixel capacitances, and the like within an electro-optical panel 200.

Specifically, the driver 100 is mounted on a rigid board as an integrated circuit device, a flexible board is connected to that rigid board, and the electro-optical panel 200 is connected to that flexible board. Interconnects are provided on the rigid board and the flexible board for connecting the data voltage output terminal TVQ of the driver 100 to a data voltage input terminal TPN of the electro-optical panel 200. Parasitic capacitance of these interconnects corresponds to the board capacitance CP1. Meanwhile, as described with reference to FIG. 1, data lines connected to the data voltage input terminal TPN, source lines, switching elements that connect the data lines to the source lines, pixel circuits connected to the source lines, and so on are provided in the electro-optical panel 200. The switching elements are constituted by TFTs (Thin Film Transistors), for example, and there is parasitic capacitance between the source and gate of each switching element. Many switching elements are connected to the data lines, and thus the parasitic capacitance of many switching elements is present on the data lines. Parasitic capacitance is also present between data lines, source lines, or the like and a panel substrate. In the liquid-crystal display panel, there is capacitance in the liquid-crystal pixels. The panel capacitance CP2 is the sum of those capacitances.

The electro-optical panel-side capacitance CP is 50 pF to 120 pF, for example. A ratio between a capacitance CO of the capacitor circuit 10 (the sum of the capacitances of the capacitors C1 to C10) and the electro-optical panel-side capacitance CP is set to 1:2, for example. In this case, the capacitance CO of the capacitor circuit 10 is 25 pF to 60 pF. Although large as a capacitance internal to an integrated circuit, the capacitance CO of the capacitor circuit 10 can be achieved by a cross-sectional structure that, for example, vertically stacks two to three levels of MIM (Metal Insulation Metal) capacitors.

In this embodiment, the data voltage is outputted through charge redistribution, and thus the data voltage is determined by a capacitance ratio. The capacitance ratio is a ratio between the capacitance CO of the capacitor circuit 10, and a capacitance obtained by adding the electro-optical panel-side capacitance CP and a capacitance CA of the variable capacitance circuit 30 (CO:CP+CA). It is necessary for the capacitance ratio to be constant (a predetermined capacitance ratio) in order for the same data voltage to be outputted for the same display data. If it is assumed here that the variable capacitance circuit 30 is not present, it is necessary to change the capacitance CO of the capacitor circuit 10 in accordance with the electro-optical panel-side capacitance CP (50 pF to 120 pF, for example) in order to achieve the predetermined ratio. In other words, a dedicated design is required for the capacitance CO of the capacitor circuit 10 in accordance with the type of the electro-optical panel 200 connected to the driver 100, the design (differences in wiring) of the circuit board on which the driver 100 or electro-optical panel 200 is mounted, and so on.

Accordingly, in this embodiment, providing the variable capacitance circuit 30 makes it possible to adjust the capacitance ratio without changing the capacitance CO of the capacitor circuit 10. In other words, CA can be adjusted so that CO:CA+CP achieves the predetermined ratio. For example, in the case where the electro-optical panel-side capacitance CP changes within a range of 50 pF to 120 pF, adjusting the capacitance of the variable capacitance circuit 30 so that CA=70 pF to 0 pF results in CA+CP=120 pF. In this case, CO:CA+CP can be set to 1:2 while keeping CO fixed at 60 pF. The variable capacitance circuit 30 will be described in detail hereinafter.

The variable capacitance circuit 30 is a circuit, serving as a capacitance connected to the data voltage output node NVQ, whose capacitance value can be set in a variable manner. Specifically, the variable capacitance circuit 30 includes first to mth switching elements SWA1 to SWAm (where m is a natural number of 2 or more), and first to mth adjusting capacitors CA1 to CAm. Note that the following will describe an example in which m=6.

The first to sixth switching elements SWA1 to SWA6 are configured as, for example, P-type or N-type MOS transistors, or as transfer gates that combine a P-type MOS transistor and an N-type MOS transistor. Of the switching elements SWA1 to SWA6, one end of an sth switching element SWAs (where s is a natural number no greater than m, which is 6) is connected to the data voltage output node NVQ.

The first to sixth adjusting capacitors CA1 to CA6 have capacitance values weighted by a power of 2. Specifically, of the adjusting capacitors CA1 to CA6, an sth adjusting capacitor CAs has a capacitance value of $2^{(s-1)}\times$CA1. One end of the sth adjusting capacitor CAs is connected to another end of the sth switching element SWAs. Another end of the sth adjusting capacitor CAs is connected to a low-potential side power source (broadly defined as a reference voltage node).

For example, in the case where CA1 is set to 1 pF, the capacitance of the variable capacitance circuit 30 is 1 pF while only the switching element SWA1 is on, whereas the capacitance of the variable capacitance circuit 30 is 63 pF (=1 pF+2 pF+ . . . +32 pF) while all the switching elements SWA1 to SWA6 are on. Because the capacitance values are weighted by a power of 2, the capacitance of the variable capacitance circuit 30 can be set from 0 pF to 63 pF in 1 pF (CA1) steps in accordance with whether the switching elements SWA1 to SWA6 are on or off.

5. Data Voltages

Next, data voltages outputted by the driver 100 with respect to the display data GD[10:1] will be described. Here, it is assumed that the capacitance ratio is set to CO:CP+CA=1:2.

Figure 9A:
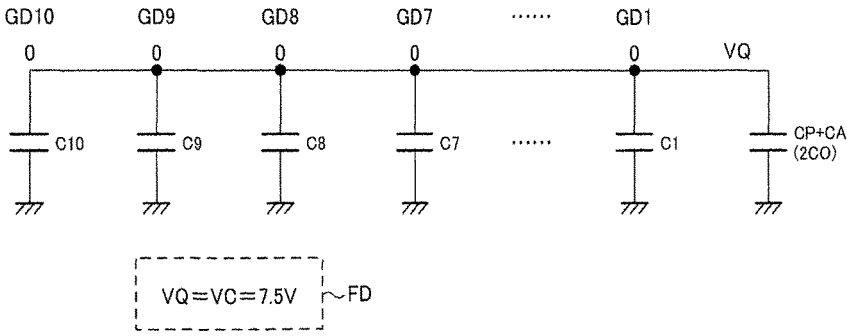
FIGS. 9A and 9B are diagrams illustrating data voltages in the second configuration example.
Figure 9B:
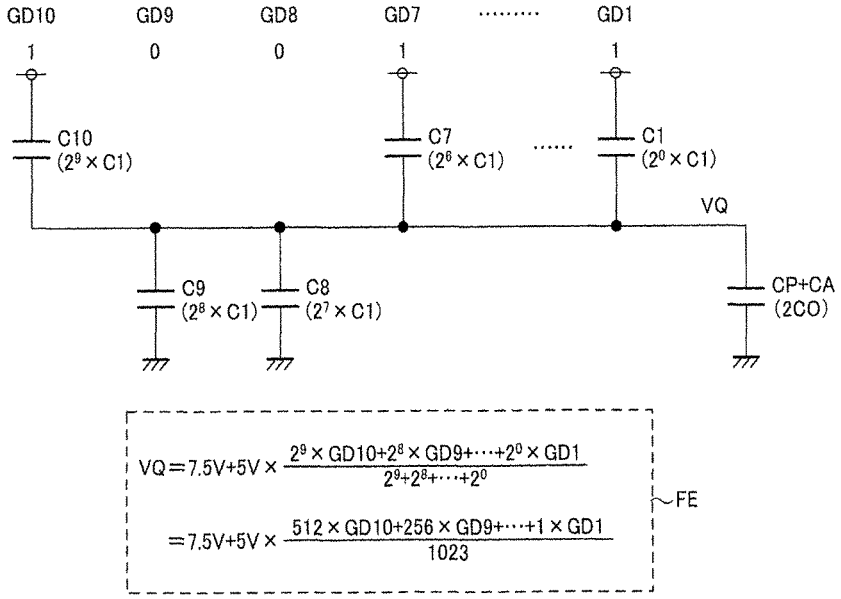

As illustrated in FIGS. 9A and 9B, the driving unit DRi outputs 0 V in the case where the ith bit GDi is "0", and the driving unit DRi outputs 15 V in the case where the ith bit GDi is "1".

As illustrated in FIG. 9A, a reset is carried out prior to driving. In other words, GD[10:1] is set to "0000000000b" (the b at the end indicates that the number within the "is binary), 0 V is outputted to the driving units DR1 to DR10, and the voltage VQ is set to VC=7.5 V, as indicated by Formula FD. VC=7.5 V corresponds to a reset voltage (a common voltage).

Next, driving is carried out, as indicated in FIG. 9B. FIG. 9B illustrates a case where GD[10:1]="1001111111b" as an example. In the reset, a charge accumulated at the data voltage output node NVQ is also conserved during the driving, and thus based on the principle of charge conservation, Formula FE in FIG. 9B is found. In Formula FE, the sign GDi expresses the value of the bit GDi ("0" or "1"). Looking at the second term on the right side of Formula FE, it can be seen that the display data GD[10:1] is converted into 1,024-tone data voltages (5 V×0/1,023, 5 V×1/1,023, 5 V×2/1,023, . . . , 5 V×1,023/1,023).

Although positive-polarity driving has been described as an example thus far, it should be noted that negative-polarity driving may be carried out in this embodiment. Inversion driving that alternates positive-polarity driving and negative-polarity driving may be carried out as well. In negative-polarity driving, the outputs of the driving units DR1 to DR10 in the capacitor driving circuit 20 are all set to 15 V in the reset, and the output voltage VQ is set to VC=7.5 V. The logic level of each bit in the display data GD[10:1] is inverted ("0" to "1" and "1" to "0"), inputted into the capacitor driving circuit 20, and capacitive driving is carried out. In this case, a VQ of 7.5 V is outputted with respect to display data GD[10:1] of "000h", a VQ of 2.5 V is outputted with respect to display data GD[10:1] of "3FFh", and the data voltage range becomes 7.5 V to 2.5 V.

According to the second configuration example described thus far, the driver 100 includes the capacitor driving circuit 20, the capacitor circuit 10, and a voltage driving circuit 80. The capacitor driving circuit 20 outputs first to tenth capacitor driving voltages (0 V or 15 V), corresponding to the display data GD[10:1], to first to tenth capacitor driving nodes NDR1 to NDR10. The capacitor circuit 10 has the first to tenth capacitors C1 to C10 provided between the first to tenth capacitor driving nodes NDR1 to NDR10 and the data voltage output terminal TVQ.

By doing so, capacitive driving can be carried out by the capacitor circuit 10 and the capacitor driving circuit 20. In the capacitive driving, the pixels are driven by charge redistribution, and thus the data voltages can be written to the pixels at higher speeds than through amplifier driving (that is, the data voltages are settled in a short amount of time). Because higher speeds are possible, an electro-optical panel having a higher number of pixels (that is, a higher resolution) can be driven. Furthermore, less power is consumed because the driving does not use an amplifier circuit. In other words, it is necessary to increase the current consumed by the amplifier circuit and increase the current consumed by ladder resistances in a tone voltage generating circuit (shorten the settling time of the tone voltages) in order for the amplifier circuit to drive a high-resolution panel at a high speed. With respect to this point, according to this embodiment, an amplifier circuit, ladder resistances and so on are not necessary, and thus there is no increase in consumed current due to the higher speed. Furthermore, the charge at the output node NVQ of the data line driving circuit is basically conserved (that is, the charge is not lost), and thus an extremely smaller current is consumed than when using an amplifier circuit.

In addition, in this embodiment, the capacitance CA of the variable capacitance circuit 30 is set so that a capacitance CA+CP obtained by adding the capacitance CA of the variable capacitance circuit 30 and the electro-optical panel-side capacitance CP (this will be called a "driven-side capacitance" hereinafter) and the capacitance CO of the capacitor circuit 10 (this will be called a "driving-side capacitance" hereinafter) have a prescribed capacitance ratio relationship (CO:(CA+CP)=1:2, for example).

By doing so, a generic driver 100 that does not depend on the connection environment of the driver 100 (the design of the mounting board, the type of the electro-optical panel 200, and so on) can be realized. In other words, even in the case where the electro-optical panel-side capacitance CP is different, the prescribed capacitance ratio relationship (for example, CO:(CA+CP)=1:2) can be realized, without changing the capacitance CO of the capacitor circuit 10, by adjusting the capacitance CA of the variable capacitance circuit 30 in accordance therewith. The data voltage range (7.5 V to 12.5 V in the example illustrated in FIGS. 4A to 4C) is determined by this capacitance ratio relationship, and thus a data voltage range that does not depend on the connection environment can be realized.

6. Third Example of Configuration of Driver

Figure 10:
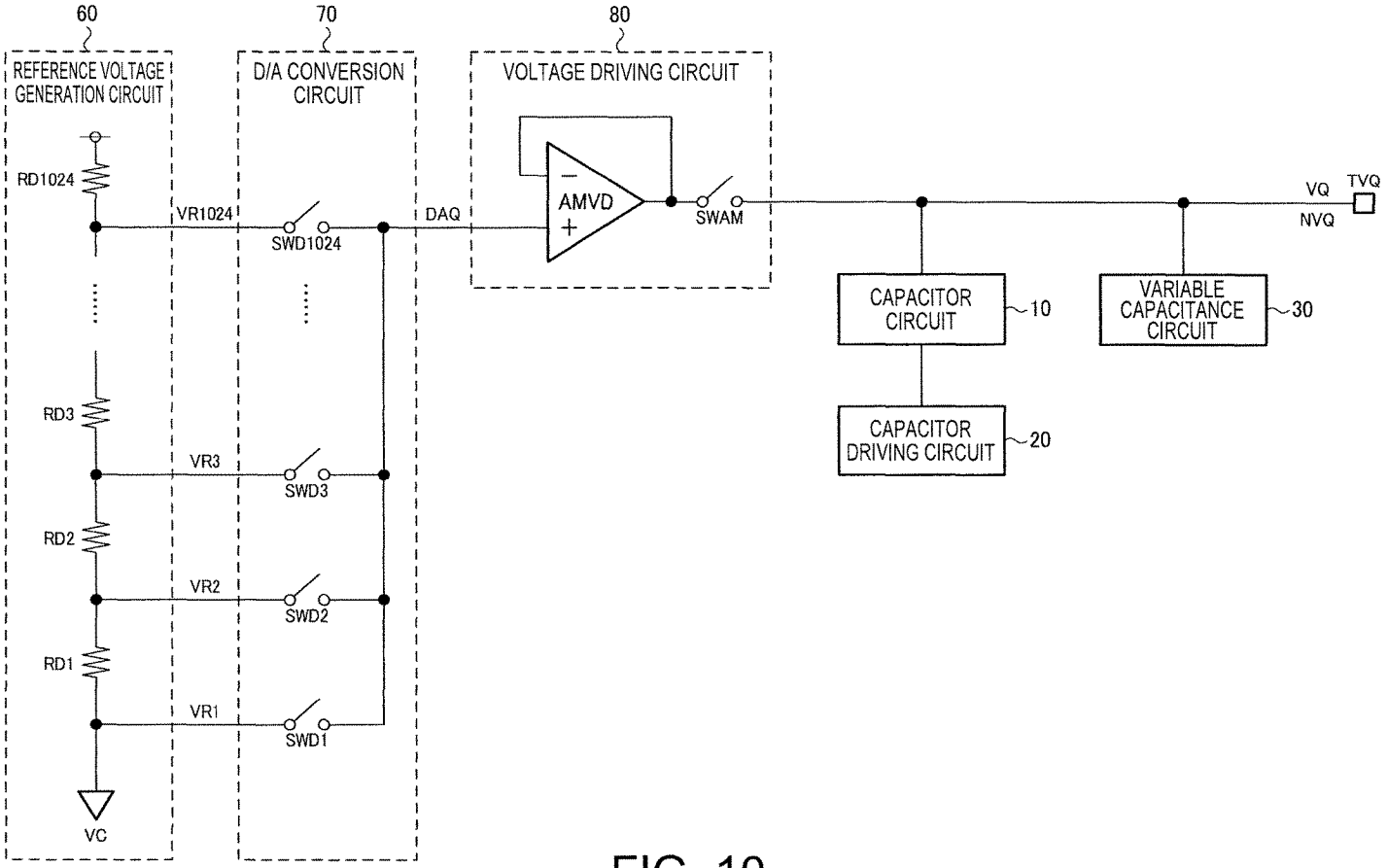
FIG. 10 illustrates a third example of the configuration of a driver.

FIG. 10 illustrates a third example of the configuration of a driver according to this embodiment. This driver 100 includes the capacitor circuit 10, the capacitor driving circuit 20, the variable capacitance circuit 30, a reference voltage generation circuit 60, a D/A conversion circuit 70 (a voltage selection circuit), the voltage driving circuit 80, and the data voltage output terminal TVQ. Although FIG. 10 illustrates a configuration corresponding to a single data line driving circuit, in reality, a plurality of data line driving circuits are provided, as illustrated in FIG. 1. The reference voltage generation circuit 60 is provided in common for the plurality of data line driving circuits. Note that constituent elements that are the same as constituent elements already described are assigned the same reference numerals, and descriptions of those constituent elements are omitted as appropriate.

The reference voltage generation circuit 60 is a circuit that generates reference voltages (tone voltages) corresponding to each value in the display data. For example, reference voltages VR1 to VR1024 for the 1,024 tones are generated corresponding to the 10-bit display data GD[10:1].

Specifically, the reference voltage generation circuit 60 includes first to 1,024th resistance elements RD1 to RF1024 connected in series between the high-potential side power source and a node at the reset voltage VC (a common voltage). The first to 1,024th reference voltages VR1 to VR1024, which are obtained through voltage division, are outputted from taps of the resistance elements RD1 to RF1024.

The D/A conversion circuit 70 is a circuit that selects a reference voltage corresponding to the display data GD[10:1], from among the plurality of reference voltages from the reference voltage generation circuit 60. The selected reference voltage is outputted as an output voltage DAQ.

Specifically, the D/A conversion circuit 70 includes first to 1,024th switching elements SWD1 to SWD1024 to one end of which the reference voltages VR1 to VR1024 are respectively supplied. Other ends of the switching elements SWD1 to SWD1024 are connected in common. One of the switching elements SWD1 to SWD1024 turns on in correspondence with the display data GD[10:1], and the reference voltage supplied to that switching element is outputted as the output voltage DAQ. An on/off control signal for the switching elements SWD1 to SWD1024 is supplied from a control circuit 40, for example, as illustrated in FIG. 11. Alternatively, the D/A conversion circuit 70 may have a decoder that decodes the display data GD[10:1], and the display data GD[10:1] may be inputted to the decoder from the control circuit 40.

Note that the configuration of the D/A conversion circuit 70 is not limited to that illustrated in FIG. 10. For example, a tournament system may be used, where the switching elements are provided in multiple stages and the selection is carried out in tournament format. In the tournament system, for example, selectors that select a single reference voltage from among 16 reference voltages are stacked in two stages (16×16=256), and a selector that selects a single reference voltage from among the four reference voltages selected by the previous stages (256×4=1,024) is provided in the third stage.

The voltage driving circuit 80 amplifies the output voltage DAQ from the D/A conversion circuit 70 and outputs the amplified voltage to the data voltage output terminal TVQ (this is called "voltage driving" hereinafter). The voltage driving circuit 80 includes an amplifier circuit AMVD and a switching circuit SWAM.

The amplifier circuit AMVD has an op-amp circuit, and the op-amp circuit is configured as, for example, a voltage follower. The output voltage DAQ from the D/A conversion circuit 70 is inputted into an input of the voltage follower.

The switching circuit SWAM is a circuit that connects/disconnects the output of the amplifier circuit AMVD to/from the data voltage output node NVQ. The switching circuit SWAM may, for example, be constituted of a single switching element, or may be configured as a circuit that includes a plurality of switching elements. An on/off control signal for the switching circuit SWAM is supplied from the control circuit 40 (a timing controller, which is not shown), for example, as illustrated in FIG. 11.

Next, operations of the stated third configuration example will be described. The following descriptions will take the data line DL1, the switching element SWEP1, and the source line SL1 illustrated in FIGS. 1 and 2 as examples.

First, precharge driving and a reset using the reset voltage VC are carried out. The precharge driving and reset have been described above and thus will not be mentioned further here. Next, capacitive driving is started, and the data line DL1 is driven by the data voltage SV1. The start of the capacitive driving corresponds to a timing at which the display data is outputted to the capacitor driving circuit 20 (a timing at which a latch that outputs the display data to the capacitor driving circuit 20 latches the display data). Once a first period has elapsed following the start of the capacitive driving, the switching circuit SWAM of the voltage driving circuit 80 turns on, and the amplifier circuit AMVD drives the data line DL1 at a voltage equal to the data voltage SV1. Next, the switching element SWEP1 turns on (this may be at the same time as the switching circuit SWAM turns on), and the source line SL1 is connected to the data line DL1.

When the switching element SWEP1 turns on and the data line DL1 and source line SL1 are connected, the source line SL1 is at the precharge voltage VPR (is different from the voltage SV1 of the data line DL1), and thus the voltages of the data line DL1 and the source line SL1 shift (drop) from SV1. In this embodiment, the data voltage SV1 is supplied by the voltage driving circuit 80, and thus the data voltage SV1 can be written into the source line SL1.

Next, the switching element SWEP1 turns off, and thereafter, the switching circuit SWAM of the voltage driving circuit 80 turns off. A period in which the switching circuit SWAM is on is a second period in which voltage driving is carried out.

According to the third configuration example as described above, first, capacitive driving can be used in the first period to quickly bring the data line to the desired data voltage, and then voltage driving (amplifier driving) can be used in the second period to accurately output the desired data voltage to the data line. In other words, combining capacitive driving and voltage driving makes it possible to realize high-speed, highly-accurate driving. The data line is already charged by the capacitive driving, and thus it is sufficient for the amplifier circuit to output a small charge in the voltage driving. Accordingly, the amplifier circuit can have a lower driving capability (circuit scale, current consumption) than in the case where capacitive driving is not carried out.

7. Detailed Configuration of Driver

FIG. 11 illustrates a detailed example of the configuration of the driver according to this embodiment. This driver 100 includes a data line driving circuit 110, the reference voltage generation circuit 60, and the control circuit 40. The data line driving circuit 110 includes the D/A conversion circuit 70, the voltage driving circuit 80, a capacitive driving circuit 90, and a detection circuit 50. The capacitive driving circuit 90 includes the capacitor circuit 10, the capacitor driving circuit 20, and the variable capacitance circuit 30. The control circuit 40 includes the correction circuit 42 (a data output circuit), an interface circuit 44, a variable capacitance control circuit 46, the register unit 48, and the non-volatile memory 49. Note that constituent elements that are the same as constituent elements already described are assigned the same reference numerals, and descriptions of those constituent elements are omitted as appropriate.

A single data line driving circuit 110 is provided corresponding to a single data voltage output terminal TVQ. Although the driver 100 includes a plurality of data line driving circuits and a plurality of data voltage output terminals, only one is illustrated in FIG. 11. The reference voltage generation circuit 60 is provided in common for the plurality of data line driving circuits (a plurality of D/A conversion circuits).

The interface circuit 44 carries out an interfacing process between a display controller 300 (broadly defined as a processing unit) that controls the driver 100 and the driver 100. For example, the interfacing process is carried out on serial communication such as LVDS (Low Voltage Differential Signaling) or the like. In this case, the interface circuit 44 includes an I/O circuit that inputs/outputs serial signals and a serial/parallel conversion circuit that carries out serial/parallel conversion on control data, image data, and so on. Meanwhile, a line latch that latches the image data inputted from the display controller 300 and converted into parallel data is also included. The line latch latches image data corresponding to a single horizontal scanning line at one time, for example.

The correction circuit 42 takes the display data GD[10:1] to be outputted to the capacitor driving circuit 20 from the image data corresponding to the horizontal scanning line, carries out the correction process on that display data GD[10:1], and outputs the corrected display data DQ[10:1] and DQ2[10:1]. The data DQ2[10:1] is outputted to the D/A conversion circuit 70. For example, the correction circuit 42 includes a selection circuit that selects the display data GD[10:1] from the image data corresponding to the horizontal scanning line, a correction unit that carries out the correction process on the selected display data GD[10:1], and an output latch that latches the corrected display data DQ[10:1] and DQ2[10:1]. Note that the control circuit 40 may include a timing controller (not shown) that controls the driving timing of the electro-optical panel 200. In the case of the phase expansion driving described with reference to FIG. 1, the output latch latches eight pixels' worth of the display data GD[10:1] (equivalent to the number of data lines DL1 to DL8) at one time. In this case, the timing controller controls the operational timing of the selection circuit, the output latch, and so on in accordance with the driving timing of the phase expansion driving. Meanwhile, a horizontal synchronization signal, a vertical synchronization signal, and so on may be generated on the basis of the image data received by the interface circuit 44. Furthermore, a signal (ENBX) for controlling the switching elements (SWEP1 and the like) in the electro-optical panel 200 on and off, a signal for controlling gate driving (selection of horizontal scanning lines in the electro-optical panel 200), and so on may be outputted to the electro-optical panel 200.

The detection circuit 50 detects the voltage VQ at the data voltage output node NVQ. Specifically, the detection circuit 50 compares a prescribed detection voltage with the voltage VQ and outputs a result thereof as a detection signal DET. For example, DET="1" is outputted in the case where the voltage VQ is greater than or equal to the detection voltage, and DET="0" is outputted in the case where the voltage VQ is less than the detection voltage.

The variable capacitance control circuit 46 sets the capacitance of the variable capacitance circuit 30 on the basis of the detection signal DET. The flow of this setting process will be described later with reference to FIG. 12. The variable capacitance control circuit 46 outputs a setting value CSW[6:1] as a control signal for the variable capacitance circuit 30. This setting value CSW[6:1] is constituted of first to sixth bits CSW6 to CSW1 (first to mth bits). A bit CSWs (where s is a natural number no greater than m, which is 6) is inputted into the switching element SWAs of the variable capacitance circuit 30. For example, in the case where the bit CSWs="0", the switching element SWAs turns off, whereas in the case where the bit CSWs="1", the switching element SWAs turns on. In the case where the setting process is carried out, the variable capacitance control circuit 46 outputs detection data BD[10:1]. Then, the correction circuit 42 outputs the detection data BD[10:1] to the capacitor driving circuit 20 as the output data DQ[10:1].

The register unit 48 stores the setting value CSW[6:1] of the variable capacitance circuit 30 set through the setting process. The register unit 48 is configured to be accessible from the display controller 300 via the interface circuit 44. In other words, the display controller 300 can read out the setting value CSW[6:1] from the register unit 48. Alternatively, the configuration may be such that the display controller 300 can write the setting value CSW[6:1] into the register unit 48.

The non-volatile memory 49 (a non-volatile storage unit) is a memory that stores driver setting values when the driver is manufactured, shipped, or the like. For example, in the case where the stated coupling coefficient has been measured by a tester, that coupling coefficient is stored. Note that in the case where the coupling coefficient has been measured by the measurement circuit 120 illustrated in FIG. 7, that coefficient may be stored in the register unit 48.

8. Process for Setting Capacitance of Variable Capacitance Circuit

Figure 12:
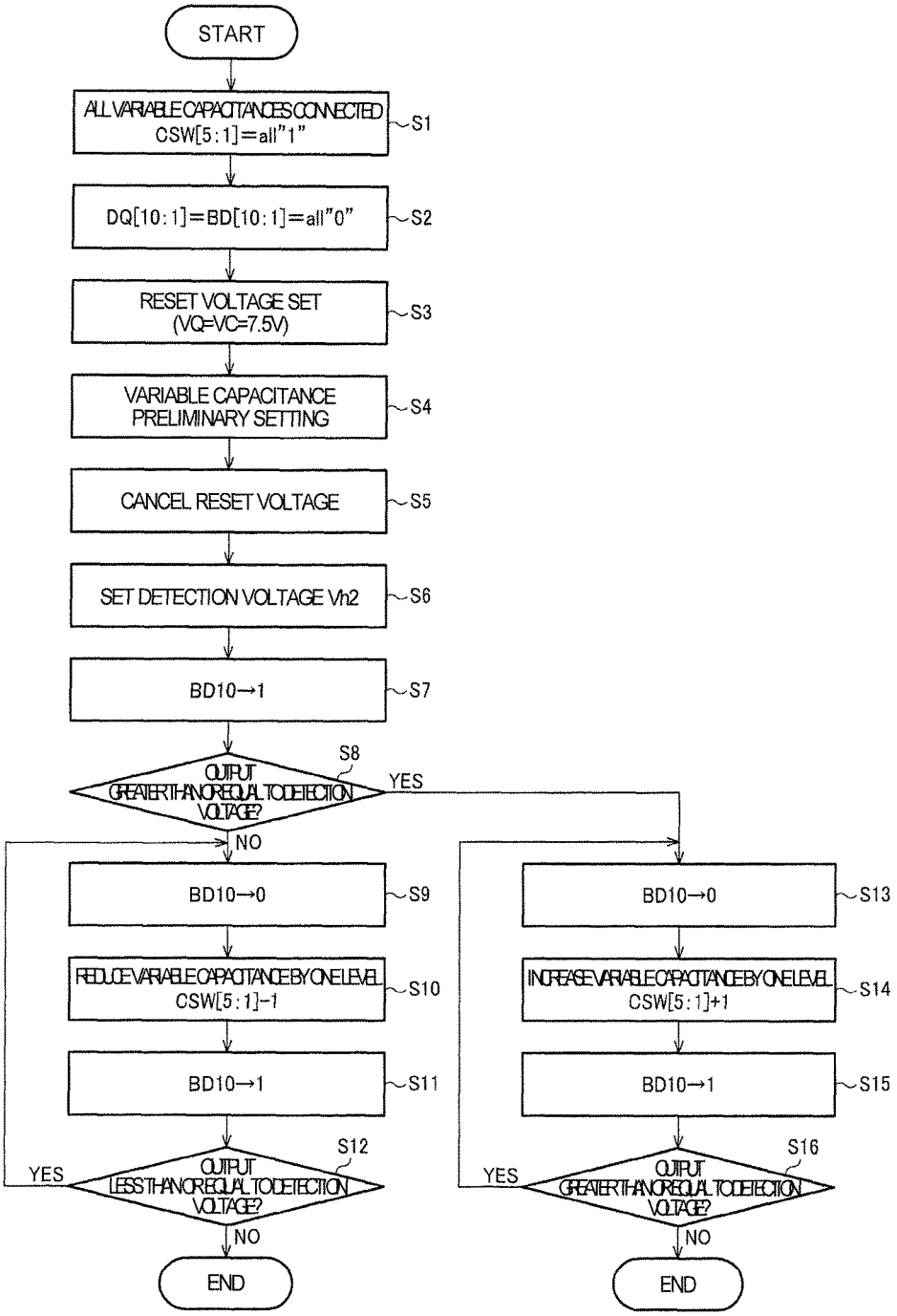
FIG. 12 is a flowchart illustrating a process for setting a capacitance of a variable capacitance circuit.

FIG. 12 is a flowchart illustrating a process for setting the capacitance of the variable capacitance circuit 30. This process is carried out, for example, during startup (an initialization process) when the power of the driver 100 is turned on.

As illustrated in FIG. 12, when the process starts, the setting value CSW[6:1] of "3Fh" is outputted, and all of the switching elements SWA1 to SWA6 of the variable capacitance circuit 30 are turned on (step S1). Next, the detection data BD[10:1] of "000h" is outputted, and the outputs of all of the driving units DR1 to DR10 of the capacitor driving circuit 20 are set to 0 V (step S2). Next, the output voltage VQ is set to the reset voltage VC of 7.5 V (step S3).

Next, the capacitance of the variable capacitance circuit 30 is preliminarily set (step S4). For example, the setting value CSW[6:1] is set to "1 Fh". In this case, the switching element SWA6 turns off and the switching elements SWA5 to SWA1 turn on, and thus the capacitance is half the maximum value. Next, the supply of the reset voltage VC to the output voltage VQ is canceled (step S5). Then, the detection voltage Vh2 is set to a desired voltage (step S6). For example, the detection voltage Vh2 is set to 10 V.

Next, the MSB of the detection data BD[10:1] is changed from BD10="0" to BD10="1" (step S7). Then, it is detected whether or not the output voltage VQ is greater than or equal to the detection voltage Vh2 of 10 V (step S8).

In the case where the output voltage VQ is less than the detection voltage Vh2 of 10 V in step S8, the bit BD10 is returned to "0" (step S9). Next, 1 is subtracted from the setting value CSW[6:1] of "1 Fh" for "1Eh" and the capacitance of the variable capacitance circuit 30 is lowered by one level (step S10). Next, the bit BD10 is set to "1" (step S11). Then, it is detected whether or not the output voltage VQ is less than or equal to the detection voltage Vh2 of 10 V (step S12). The process returns to step S9 in the case where the output voltage VQ is less than or equal to the detection voltage Vh2 of 10 V, and the process ends in the case where the output voltage VQ is greater than the detection voltage Vh2 of 10 V.

In the case where the output voltage VQ is greater than or equal to the detection voltage Vh2 of 10 V in step S8, the bit BD10 is returned to "0" (step S13). Next, 1 is added to the setting value CSW[6:1] of "1Fh" for "20h" and the capacitance of the variable capacitance circuit 30 is raised by one level (step S14). Next, the bit BD10 is set to "1" (step S15). Then, it is detected whether or not the output voltage VQ is greater than or equal to the detection voltage Vh2 of 10 V (step S16). The process returns to step S13 in the case where the output voltage VQ is greater than or equal to the detection voltage Vh2 of 10 V, and the process ends in the case where the output voltage VQ is less than the detection voltage Vh2 of 10 V.

The setting value CSW[6:1] obtained through the above processing is determined as the final setting value CSW[6:1], and that setting value CSW[6:1] is written into the register unit 48. When driving the electro-optical panel 200 through capacitive driving, the capacitance of the variable capacitance circuit 30 is set using the setting value CSW[6:1] stored in the register unit 48.

Although this embodiment describes an example in which the setting value CSW[6:1] of the variable capacitance circuit 30 is stored in the register unit 48, the invention is not limited thereto. For example, the setting value CSW[6:1] may be stored in a memory such as a RAM or the like, stored in the non-volatile memory 49 (where the setting value is determined by a tester at the time of manufacture, shipping, or the like, for example), or the setting value CSW[6:1] may be set using a fuse (for example, setting the setting value through cutting by a laser or the like during manufacture).

9. Electro-Optical Apparatus, Electronic Device

Figure 13:
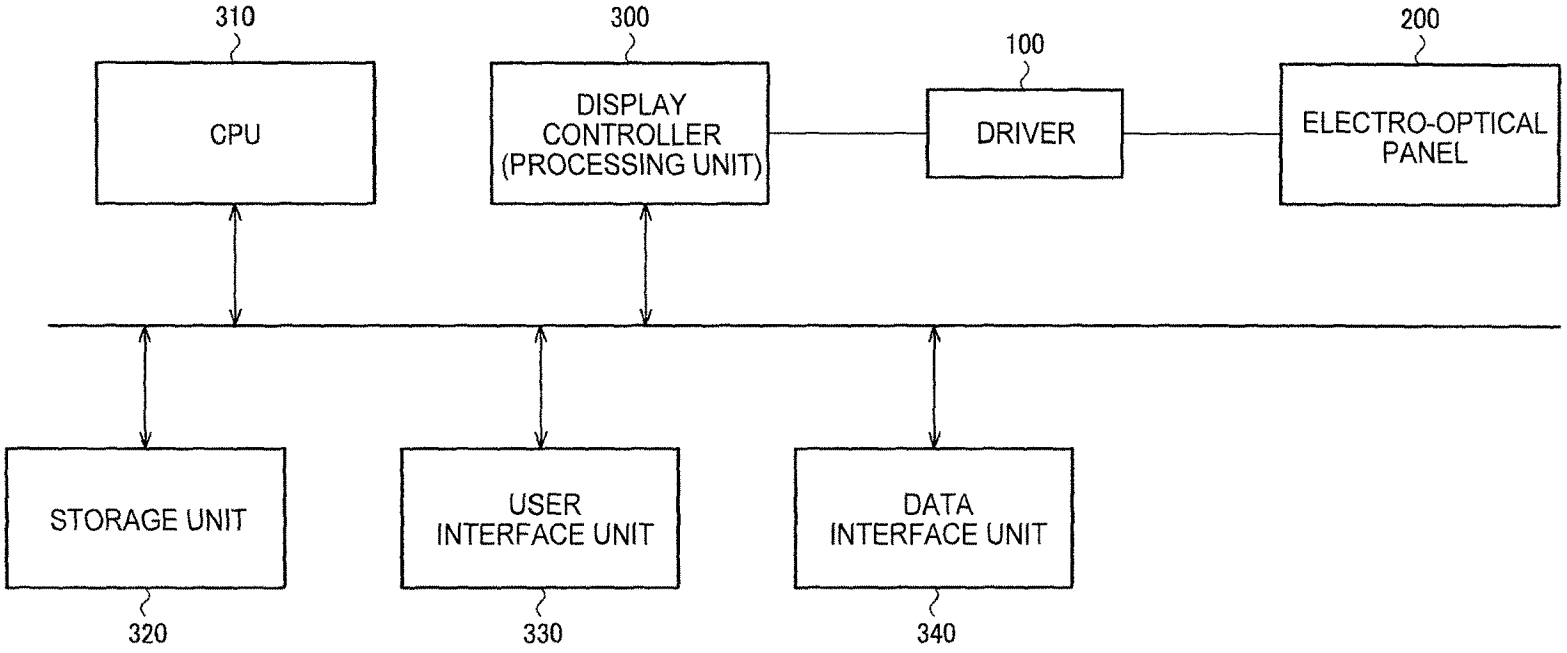
FIG. 13 illustrates an example of the configuration of an electro-optical apparatus and an electronic device.

FIG. 13 illustrates an example of the configuration of an electronic device in which the driver 100 according to this embodiment can be applied. A variety of electronic devices provided with display devices can be considered as the electronic device according to this embodiment, including projector, a television device, an information processing apparatus (a computer), a mobile information terminal, a car navigation system, a mobile gaming terminal, and so on, for example.

The electronic device illustrated in FIG. 13 includes the driver 100, the electro-optical panel 200, the display controller 300 (a host controller, a first processing unit), a CPU 310 (a second processing unit), a storage unit 320, a user interface unit 330, and a data interface unit 340.

The electro-optical panel 200 is a matrix-type liquid-crystal display panel, for example. Alternatively, the electro-optical panel 200 may be an EL (Electro-Luminescence) display panel using selfluminous elements. For example, a flexible board for leading out wires is connected to the electro-optical panel 200, the driver 100 is mounted on a rigid board along with the display controller 300 and the like, and the electro-optical panel 200 is mounted by connecting the flexible board to the rigid board. Alternatively, the driver 100 may be mounted on the flexible board connected to the electro-optical panel 200. In this case, the electro-optical panel 200, the flexible board connected thereto, and the driver 100 mounted thereon are called an electro-optical apparatus.

The user interface unit 330 is an interface unit that accepts various operations from a user. The user interface unit 330 is constituted of buttons, a mouse, a keyboard, a touch panel with which the electro-optical panel 200 is equipped, or the like, for example. The data interface unit 340 is an interface unit that inputs and outputs image data, control data, and the like. For example, the data interface unit 340 is a wired communication interface such as USB, a wireless communication interface such as a wireless LAN, or the like. The storage unit 320 stores image data inputted from the data interface unit 340. Alternatively, the storage unit 320 functions as a working memory for the CPU 310, the display controller 300, or the like. The CPU 310 carries out control processing for the various units in the electronic device, various types of data processing, and so on. The display controller 300 carries out control processing for the driver 100. For example, the display controller 300 converts image data transferred from the data interface unit 340, the storage unit 320, or the like into a format that can be handled by the driver 100, and outputs the converted image data to the driver 100. The driver 100 drives the electro-optical panel 200 on the basis of the image data transferred from the display controller 300.

Although the foregoing has described embodiments of the invention in detail, one skilled in the art will easily recognize that many variations can be made thereon without departing from the essential spirit of the novel items and effects of the invention. Such variations should therefore be taken as being included within the scope of the invention. For example, in the specification or drawings, terms denoted at least once along with terms that have broader or the same definitions as those terms ("low-level" and "high-level" for "first logic level" and "second logic level", respectively) can be replaced with those terms in all areas of the specification or drawings. Furthermore, all combinations of the embodiments and variations fall within the scope of the invention. Finally, the configurations and operations of the capacitor circuit, capacitor driving circuit, variable capacitance circuit, correction circuit, control circuit, driver, electro-optical panel, electro-optical apparatus, and electronic device are not limited to those described in the embodiments, and many variations can be made thereon.

The entire disclosure of Japanese Patent Application No. 2015-012989, filed Jan. 27, 2015 is expressly incorporated by reference herein.

What is claimed is:

1. A driver comprising:

a driving circuit having first to kth data line driving circuits that drive first to kth data lines (where k is a natural number of 2 or more) of an electro-optical panel;

a measurement circuit that measures a voltage in an ith data line among the first to kth data lines (where i is a natural number less than or equal to k), the ith data line being in a floating state where no voltage is applied to the ith data line, the measurement circuit measuring the voltage in the ith data line that is in the floating state as a voltage applied to a data line adjacent to the ith data line changes from a first voltage to a second voltage; and a computation circuit that computes a correction coefficient for correcting display data on the basis of a measurement result from the measurement circuit, the correction coefficient changing in accordance with coupling capacitance between the ith data line of the first to kth data lines and the data line adjacent to the ith data line.

2. The driver according to claim 1, wherein the correction coefficient is a correction coefficient based on a ratio of the coupling capacitance to an overall capacitance of the ith data line.

3. The driver according to claim 1, wherein the correction coefficient includes a first correction coefficient based on a first coupling capacitance between the ith data line and an i−1th data line of the first to kth data lines, and a second correction coefficient based on a second coupling capacitance between the ith data line and an i+1th data line of the first to kth data lines.

4. The driver according to claim 3, wherein the first correction coefficient is a correction coefficient based on a ratio of the first coupling capacitance to an overall capacitance of the ith data line; and the second correction coefficient is a correction coefficient based on a ratio of the second coupling capacitance to the overall capacitance of the ith data line.

5. The driver according to claim 1, wherein the ith data line driving circuit sets the ith data line to a data voltage corresponding to the display data by controlling an amount of a charge supplied to the ith data line.

6. The driver according to claim 1, wherein the computation circuit changes the display data supplied to the i+1th data line driving circuit of the first to kth data line driving circuits from first display data to second display data;

the measurement circuit measures an amount of change in the voltage of the ith data line; and the computation circuit computes the correction coefficient based on the coupling capacitance between the ith data line and the i+1th data line of the first to kth data lines on the basis of the amount of change in the voltage.

7. The driver according to claim 6, wherein when the computation circuit changes the display data supplied to the i+1th data line driving circuit from the first display data to the second display data, the ith data line driving circuit sets the ith data line to a state in which a charge in the ith data line is conserved.

8. The driver according to claim 1, further comprising:

a correction circuit that carries out a correction process on the display data and supplies the corrected display data to the driving circuit, wherein the correction circuit supplies, to the ith data line driving circuit of the first to kth data line driving circuits, the display data corrected using the correction coefficient based on the coupling capacitance between the ith data line and the data line adjacent to the ith data line.

9. The driver according to claim 8, wherein the correction circuit carries out the correction process on the display data corresponding to the ith data line on the basis of a value of change in the display data corresponding to the data line adjacent to the ith data line and on the basis of the correction coefficient.

10. The driver according to claim 9, wherein the correction circuit carries out the correction process on the display data corresponding to the ith data line using a value obtained by multiplying the value of change with the correction coefficient.

11. The driver according to claim 1, wherein the ith data line driving circuit of the first to kth data line driving circuits includes:

a capacitor driving circuit that outputs first to nth capacitor driving voltages (where n is a natural number of 2 or more) corresponding to the display data to first to nth capacitor driving nodes; and a capacitor circuit having first to nth capacitors provided between the first to nth capacitor driving nodes and a data voltage output terminal.

12. An electro-optical apparatus comprising:
the driver according to claim 1; and
an electro-optical panel.

13. An electro-optical apparatus comprising:
the driver according to claim 2; and
an electro-optical panel.

14. An electro-optical apparatus comprising:
the driver according to claim 3; and
an electro-optical panel.

15. An electro-optical apparatus comprising:
the driver according to claim 4; and
an electro-optical panel.

16. An electro-optical apparatus comprising:
the driver according to claim 5; and
an electro-optical panel.

17. An electro-optical apparatus comprising:
the driver according to claim 6; and
an electro-optical panel.

18. An electro-optical apparatus comprising:
the driver according to claim 7; and
an electro-optical panel.

19. An electro-optical apparatus comprising:
the driver according to claim 8; and
an electro-optical panel.

20. An electronic device comprising the driver according to claim 1.

* * * * *